US008673113B2

(12) United States Patent
Beatson et al.

(10) Patent No.: US 8,673,113 B2
(45) Date of Patent: Mar. 18, 2014

(54) PROCESS FOR REDUCING SPECIFIC ENERGY DEMAND DURING REFINING OF THERMOMECHANICAL AND CHEMI-THERMOMECHANICAL PULP

(75) Inventors: Rodger R. Beatson, Burnaby (CA); Xue Feng Chang, Burnaby (CA)

(73) Assignee: The University of British Columbia, Vancouver (CA)

( * ) Notice: Subject to any disclaimer, the term of this patent is extended or adjusted under 35 U.S.C. 154(b) by 313 days.

(21) Appl. No.: 12/797,585

(22) Filed: Jun. 9, 2010

(65) Prior Publication Data

US 2011/0303372 A1 Dec. 15, 2011

(51) Int. Cl.
*D21B 1/14* (2006.01)
*D21B 1/16* (2006.01)
*D21C 9/16* (2006.01)

(52) U.S. Cl.
CPC .. *D21B 1/14* (2013.01); *D21B 1/16* (2013.01); *D21C 9/163* (2013.01)
USPC ..... 162/24; 162/26

(58) Field of Classification Search
CPC ..... D21B 1/02; D21B 1/1021; D21B 1/14; D21B 1/16; D21C 9/16; D21C 9/163
USPC ..... 162/24
See application file for complete search history.

(56) References Cited

U.S. PATENT DOCUMENTS 4,270,976 A 6/1981 Sandstrom et al.
4,718,980 A * 1/1988 Lowrie et al. ..... 162/78
4,734,160 A 3/1988 Moldenius
7,300,541 B2 11/2007 Sabourin
2004/0069427 A1 4/2004 Xu (Continued)

FOREIGN PATENT DOCUMENTS

EP 2071074 A1 6/2009

OTHER PUBLICATIONS

Sundholm et al editor, Mechnical Pulping, 1999,FAPET OY, p. 75, 200-201,289,318-329, 332-334, 351-352, 365-373, and 401-402.*

(Continued)

*Primary Examiner* — Anthony Calandra
(74) *Attorney, Agent, or Firm* — Morrison & Foerster LLP

(57) ABSTRACT

A method for producing thermomechanical or chemi-thermomechanical pulp is provided. The process is characterized as having a reduced specific energy demand during refining. The process involves processing a pretreated wood material using one or more high consistency refining steps to produce a first pulp, optionally applying a chelating agent to the first pulp during HC refining to produce a stabilized pulp and treating the first or stabilized pulp with an alkaline-peroxide liquor to produce a treated pulp. The treated pulp is then processed by one or more second low consistency refining steps. Alternatively, the first pulp or stabilized pulp may be divided into a primary and secondary stream. The primary stream is treated with alkaline-peroxide liquor to produce a treated pulp. The secondary stream is processed using a secondary HC refining step to produce a partially refined pulp, and removing latency of the partially refined pulp and the treated pulp is removed in a common location. The treated pulp and the partially treated pulp is processed by one or more than one second low consistency refining step to produce a final pulp. The methods utilize less energy when compared with a method for producing pulp that requires both primary and secondary high consistency refining stages.

8 Claims, 17 Drawing Sheets

(56) References Cited

U.S. PATENT DOCUMENTS

| | | | | |
|---|---|---|---|---|
| 2007/0125507 | A1 | 6/2007 | Walter et al. | |
| 2008/0035286 | A1 | 2/2008 | Aichinger et al. | |
| 2008/0105392 | A1 * | 5/2008 | Duggirala et al. | 162/23 |
| 2009/0032207 | A1 | 2/2009 | Laurila-Lumme et al. | |
| 2009/0288789 | A1 | 11/2009 | Sabourin et al. | |

OTHER PUBLICATIONS

Smook, Handbook for Pulp and Paper Technologists, 1992, Angus Wilde Publications, 2nd edition, chapter 13.*
Ampulski, Robert S., "The Influence of Fiber Surface Charge on Tensile Strength", Tappi Proceedings, 1985, pp. 9-16.
Atack et al., "Ultra High Yield Pulping of Eastern Black Spruce", Svensk Papperstidning nr 5, 1978, pp. 164-175.
Barzyk et al., "Carboxylic Acid Groups and Fibre Bonding", Transactions of the 11th Fundamental Research Symposium, 1997, pp. 893-907.
Beatson, R. P., "Determination of Sulfonate Groups end Total Sulfur", Methods in Lignin Chemistry, 1992, pp. 473-484.
Been, Jenny, "A Nove Appoach to Kinetc Modeing of the Hydrogen Peroxide Brightening of Mechanical Pup", Tappi Journal, vol. 78, No. 8, Aug. 1995, pp. 144-152.
Bian et al., "Improving TMP Rejects Refining Through Alkaline Peroxide Pre-treatment or Value-Added Mechanical Papers", IPMC, 2007, 18 pages.
Bian et al., "Improving TMP Rejects Refining through Alkaline Peroxide Pretreatment for Value-added Mechanical Papers", Tappi Journal, vol. 6, No. 3, Mar. 2007, pp. 24-32.
Bohn et al., "Alkaline Peroxide Mechanical Pulping, A Revolution in High Yield Pulping", International Mechanical Pulping Conference, 1989, 17 pages.
Engstrand et al., "The Significance of Carboxylic Groups far the Physical Properties of Mechanical Pulp Fibers" 6th International Symposium Wood Pulping Chemistry, 1991, pp. 75-79.
French et al., "A Mini Pulp Evaluation Procedure", Appita, vol. 47, No. 1, 1994, pp. 38-43.
Hammar et al., "The Effect of Process Conditions on Pulp Quality Development at Low Consistency Refining of Mechanical Pulp—TMP", Proceedings International Mechanical Pulping Conference, 2009, 4 pages.
Korpela, Antti, "Improving the Strength of PGW Pine Pulp by Alkaline Peroxide Treatment", Nordic Pulp and Paper Research Journal, vol. 17, No. 2, 2002, pp. 183-186.
Moldenius, S., "The Effects of Peroxide Bleaching on the Strength and Surface Properties of Mechanical Pulping", Journal of Pulp and Paper Science, Nov. 1984, pp. J172-J177.
Muenster et al., "Energy Savings in TMP by High Temperature LC/MC Refining", International Mechanical Pulping Conference, Oslo, Norway, 2005, pp. 1-5.
Musselman et al., "Third Stage Low Consistency Refining of TMP for Energy Savings and Quality Enhancement", 4th International Refining Conference Fuiggi, Italy, 1997, pp. 1-7.
Pan, George X., "Relationship Between Dissolution of Fiber Materials and Development of Pulp Strength in Alkaline Peroxide Bleaching of Mechanical Pulp", Holzforschung, vol. 58, 2004, pp. 369-374.
Presley et al., "Peroxide Bleaching of (chemi) Mechanical Pulps", Pulp Bleaching: Principles and Practice, 1996, pp. 457-489.
Sandberg et al., "Potential of Low Consistency Refining of TMP-Mill Evaluation", Proceedings International Mechanical Pulping Conference, 2009, 4 pages.
Scallan et al., "The Effect of Cations on Pulp and Paper Properties", Svensk Papperstidning nr 2, 1979, pp. 40-47.
Shallhorn et al., "Tear and Tensile Strength of Mechanical Pulps", Transactions, Dec. 1979, pp. TR92-TR99.
Shaw, A. C., "Simulation of Secondary Refining", Pulp & Paper Canada, vol. 85, No. 6, 1984, pp. 107-112.
Steadman et al., "The Effect of Wet Fibre Flexibility on Sheet Apparent Density", Papermaking Raw Materials, 1985, pp. 311-337.
Burkhart et al., "Tailormade mechanical pulps provide a lower cost fiber mix for high quality coated graphic paper grades", International Mechanical Pulping Conference technical sessions, 2001, 10 pages.
Harrison et al., "Refiner Bleaching With Magnesium Hydroxide (Mg(OH)2) and Hydrogen Peroxide", Tappi Journal, Sep. 2008, 8 pages.
Xu et al., "Some latest developments in alkali peroxide mechanical pulping part 2—low consistency secondary refining", Pulp & Paper Canada, vol. 104, No. 10, 2003, 7 pages.
Zhang et al., "Successful Start-up and Commercial Operation Experience with P-RC APMP at Yueyang Paper Mill", Proceeding of IMPC, Oslo, Norway, Jun. 6-9, 2005 , 4 pages.

* cited by examiner

PROCESS FOR REDUCING SPECIFIC ENERGY DEMAND DURING REFINING OF THERMOMECHANICAL AND CHEMI-THERMOMECHANICAL PULP

FIELD OF INVENTION

The present invention relates to a process to reduce specific energy demand during refining of thermomechanical or chemi-thermomechanical pulp. More specifically, it relates to a process that produces thermomechanical or chemi-thermomechanical pulp comprising alkaline peroxide treatment.

BACKGROUND OF THE INVENTION

Thermomechanical pulping (TMP) and chemi-thermomechanical pulping (CTMP) processes refine fibrous material at high consistency (HC), typically having 20 percent (20%) or more fiber by weight of the pulp suspension passing through the mainline and rejects refiners. With HC refining, the pulp suspension is a fibrous mass and is transported by a pressurized blowline or screw conveyor which can handle such masses. In contrast, pulp suspensions in low consistency (LC) refining flow as a liquid slurry that can be moved by pumps.

Mechanically refining pulp at a high consistency requires a large amount of energy that is expended primarily in frictional heat losses associated with viscoelastic deformations of the pulp in the refining zone. These frictional heat losses result in a large amount of energy that is not applied directly to refining pulp. Typically less than 10% to 15% of the electric energy applied in a HC TMP or CTMP refiner is directly applied to refining the pulp.

One way to reduce the energy demand of conventional TMP and CTMP processes is to install LC refining following primary and secondary HC refining and the latency removal chest. Using this approach, energy savings of 5% to 8% or even more have been reported without sacrificing pulp properties. Similar tear strength and sometimes even slightly higher tensile strength and lower shive levels have been reported. This third stage low consistency refining approach has found relatively wide acceptance particularly in North America and usually provides increased capacity for TMP or CTMP lines. There is a need for improved energy efficiency in refiner-based pulping.

Alkaline peroxide is conventionally used for brightening of mechanical pulps after refining. Moldenius [2] and U.S. Pat. No. 4,734,160 found that the brightening process of mechanical pulps with hyper alkaline peroxide (pH 12-13) can serve to simultaneously enhance both brightness and tensile strength, depending on the alkali and peroxide charges used. The application of alkaline peroxide has also been used with TMP screen rejects [4].

US 2009/0032207 describes a method for producing mechanical or chemi-mechanical pulp as raw material for paper or cardboard in which the pulp is fibrillated and the fibrillated pulp is bleached in alkaline conditions. The pulp is screened to separate the rejects from the accepts. The rejects are bleached separate from the accepts, and, after that, the bleached rejects are remixed with the accepts.

U.S. Pat. No. 6,743,332 describes a process for producing mechanical pulp using a bleaching liquor comprising a hydrogen peroxide-magnesium hydroxide or soda ash mixture (replacing sodium hydroxide), at a temperature of 85-160 degrees C., and up to a pH of about 9-10.5. The pH range was selected to prevent peroxide decomposition and alkali darkening.

US 2008/0035286 discloses a method for processing lignocellulosic material involving the use of a non-compression vessel or digester to chemically precondition wood chips with stabilizers, washing, fiberizing the preconditioned chips and processing the fiberized material using a high consistency refiner in the presence of alkali peroxide, followed by low consistency refining.

SUMMARY OF THE INVENTION

The present invention relates to a process to reduce specific energy demand during refining of thermomechanical or chemi-thermomechanical pulp. More specifically, it relates to a process that produces thermomechanical or chemi-thermomechanical pulp comprising alkaline peroxide.

It is an object of the invention to provide an improved process for reducing specific energy demand during refining of thermomechanical and chemi-thermomechanical pulp.

According to the present invention there is provided a process (A) for producing thermomechanical and/or chemi-thermomechanical pulp comprising:

(a) processing pretreated wood material by at least one high consistency (HC) refining step to produce a first pulp;

(b) optionally applying a chelating agent to the first pulp during HC refining to produce a stabilized pulp;

(c) treating the stabilized or first pulp with an alkaline-peroxide liquor to produce a treated pulp;

(d) removing latency of the treated pulp; and (e) processing the treated pulp by one or more second refining steps to produce a final pulp.

The present invention also provides the process (A) as defined above, wherein the alkaline-peroxide has a pH of from about 11 to about 13. Furthermore, the alkaline peroxide liquor may comprise hydrogen peroxide, sodium hydroxide and one or more stabilizer agents. The hydrogen peroxide may be between 0.5-4% (wt/wt), the sodium hydroxide is between 0.5-7% (wt/wt). The stabilizing agent may be sodium silicate, magnesium sulfate or an organic material that stabilizes alkaline peroxide.

The at least one HC refining step may consists of a primary HC refiner. A chelating agent may be added during the processing step using at least one HC refining step. The pretreated wood material may include wood chips that have been preconditioned with steam and/or chemicals including sodium sulfite, sodium bisulfite and hydrogen peroxide at an alkaline pH.

The present invention provides a process as described above, wherein the one or more second refining steps comprises low consistency (LC) refining steps. Additionally, the at least one refining step does not comprise a screening step.

The present invention also pertains to a method (A') of decreasing energy requirement during high consistency refining of thermomechanical and/or chemi-thermomechanical pulp comprising:

(a) processing pretreated wood material by at least one high consistency (HC) refining step to produce a first pulp;

(b) optionally applying a chelating agent to the first pulp during HC refining to produce a stabilized pulp;

(c) treating the stabilized or first pulp with an alkaline-peroxide liquor to produce a treated pulp;

(d) removing latency of the treated pulp; and (e) processing the treated pulp by one or more second refining steps to produce a final pulp.

The present invention also provides the process (A') as defined above, wherein the alkaline-peroxide has a pH of from about 11 to about 13. Furthermore, the alkaline peroxide liquor may comprise hydrogen peroxide, sodium hydroxide and one or more stabilizer agents. The hydrogen peroxide may be between 0.5-4% (wt/wt), the sodium hydroxide is between 0.5-7% (wt/wt). The stabilizing agent may be sodium silicate magnesium sulfate or an organic material that stabilizes alkaline peroxide. Furthermore, the at least one HC refining step may consists of a primary HC refiner. A chelating agent may be added during the processing step using at least one HC refining step. The pretreated wood material may include wood chips that have been preconditioned with steam and/or chemicals including sodium sulfite, sodium bisulfite and hydrogen peroxide at an alkaline pH. The one or more second refining step may comprises a low consistency (LC) refining step. Additionally, the at least one refining step does not comprise a screening step.

The present invention also provides a process (B) for producing thermomechanical and/or chemi-thermomechanical pulp comprising:

(a) processing a pretreated wood material using one high consistency (HC) refining step to produce a first pulp;

(b) optionally applying a chelating agent to the first pulp during HC refining to produce a stabilized pulp (c) dividing the first pulp or stabilized pulp into a primary and a secondary stream;

(d) processing the secondary stream using a secondary HC refining step to produce a partially refined pulp;

(e) treating the primary stream with alkaline-peroxide liquor to produce a treated pulp;

(f) removing the latency of the partially refined pulp and the treated pulp in a common location; and (g) processing the partially treated pulp, and the treated pulp by one or more than one second low consistency refining step to produce a second pulp.

In the process (B) defined above, a volume of first pulp entering the secondary HC refiner via the secondary stream may be from about 0 to about 75%, of the volume of primary stream that is directly processed by alkaline pretreatment, or any volume therebetween.

The present invention also provides the process (B) as defined above, wherein the alkaline-peroxide has a pH of from about 11 to about 13. Furthermore, the alkaline peroxide liquor may comprise hydrogen peroxide, sodium hydroxide and one or more stabilizer agents. The hydrogen peroxide may be between 0.5-4% (wt/wt), the sodium hydroxide is between 0.5-7% (wt/wt). The stabilizing agent may be sodium silicate magnesium sulfate or an organic material that stabilizes alkaline peroxide.

The at least one HC refining step may consists of a primary HC refiner. A chelating agent may be added during the processing step using at least one HC refining step. The pretreated wood material may include wood chips that have been preconditioned with steam and/or chemicals including sodium sulfite, sodium bisulfite and hydrogen peroxide at an alkaline pH.

The present invention also embraces a method (B') of decreasing energy requirement during high consistency refining of mechanical and/or thermomechanical pulp comprising:

(a) processing a pretreated wood material using one high consistency (HC) refining step to produce a first pulp;

(b) optionally applying a chelating agent to the first pulp during HC refining to produce a stabilized pulp;

(c) dividing the first pulp or stabilized pulp into a primary and a secondary stream;

(d) processing the secondary stream using a secondary HC refining step to produce a partially refined pulp;

(e) treating the primary stream with alkaline-peroxide liquor to produce a treated pulp;

(f) removing the latency of the partially refined pulp and the treated pulp in a common location; and (g) processing the partially treated pulp, and the treated pulp by one or more than one second low consistency refining step to produce a second pulp.

In the process (B') defined above, a volume of first pulp entering the secondary HC refiner via the secondary stream may be from about 0 to about 75%, of the volume of primary stream that is directly processed by alkaline pretreatment, or any volume therebetween.

The present invention also provides the process (B') as defined above, wherein the alkaline-peroxide has a pH of from about 11 to about 13. Furthermore, the alkaline peroxide liquor may comprise hydrogen peroxide, sodium hydroxide and one or more stabilizer agents. The hydrogen peroxide may be between 0.5-4% (wt/wt), the sodium hydroxide is between 0.5-7% (wt/wt). The stabilizing agent may be sodium silicate magnesium sulfate or an organic material that stabilizes alkaline peroxide.

The at least one HC refining step may consists of a primary HC refiner. A chelating agent may be added during the processing step using at least one HC refining step. The pretreated wood material may include wood chips that have been preconditioned with steam and/or chemicals including sodium sulfite, sodium bisulfite and hydrogen peroxide at an alkaline pH.

By providing either process (A), process (B), method (A') or method (B') as outlined above, that utilize low consistency (LC) refining following treating the pulp with alkaline peroxide after a one step of HC refining, or by diverting only a portion of the volume of the first pulp to a second HC refining step, the specific energy required to achieve desired pulp quality is reduced, and electrical energy savings are gained.

Furthermore, in either of the process (A), process (B), method (A') or method (B') as described above, more than one second refining step, for example, a step of low consistency refining, may be used to achieve the desired freeness and quality of the second pulp. With this method, energy is diverted from the energy intensive step of secondary HC refining, to additional steps of LC refining which, due to a reduced consistency of pulp, and flexibility of the alkaline treated pulp consume less energy.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Figure 1:
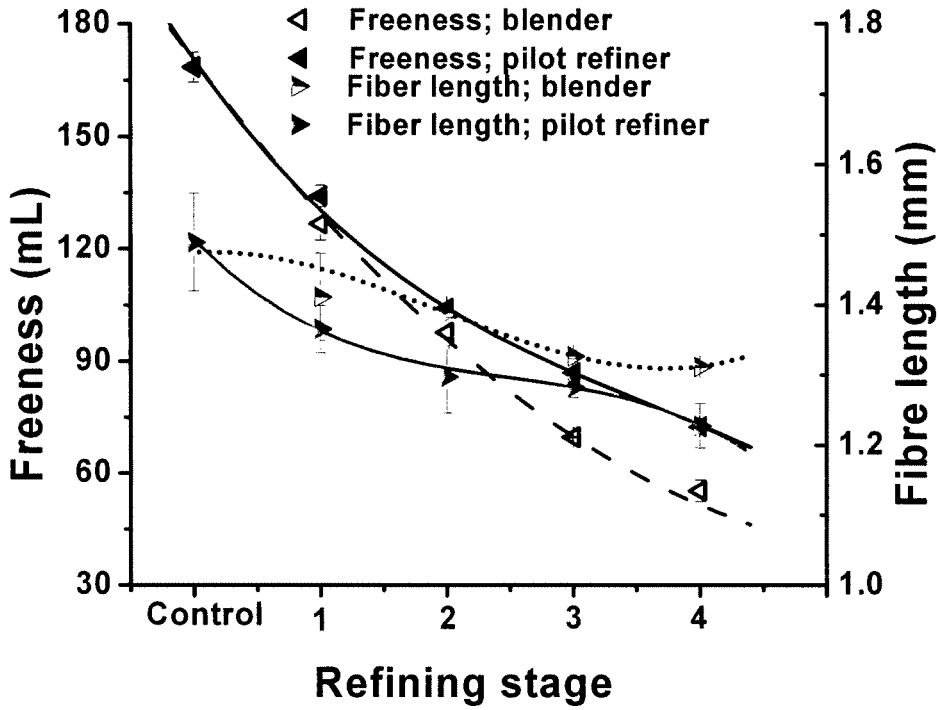
FIG. 1 shows a graph of freeness (mL) and Fiber length (mm) of pulp treated either by a blender or a pilot refiner. Ten minutes of blending results in similar freeness drops to 110 kWh/t in the pilot LCR refiner. Fiber length is slightly higher at a given freeness for blending. (Refining stages: 10 min blending; 90 kWh/t Pilot refiner)

The present invention relates to a process to reduce specific energy demand during refining of thermomechanical (TMP) or chemi-thermomechanical pulp (CTMP). More specifically, it relates to a process that produces TMP or CTMP comprising alkaline peroxide treatment. The invention also relates to a process that produces TMP or CTMP comprising alkaline peroxide treatment of high-consistency (HC) refined fiber followed by low-consistency (LC) refining to achieve final pulp quality specifications meeting or exceeding those now achieved through multiple stages of HC refining.

The present invention provides a process for producing TMP and/or CTMP comprising, processing pretreated wood material by at least one high constancy (HC) refining step to produce a first pulp, optionally applying a chelating agent to the first pulp during HC refining to produce a stabilized pulp, treating the first or stabilized pulp with an alkaline-peroxide liquor to produce a treated pulp, removing latency of the treated pulp and processing the treated pulp by one or more second refining steps to produce a final pulp.

The present invention also provides an alternate process for producing TMP and/or CTMP comprising, processing a pretreated wood material using one high consistency (HC) refining step to produce a first pulp, optionally applying a chelating agent to the first pulp during HC refining to produce a stabilized pulp, dividing the first or stabilized pulp into a primary and a secondary stream, processing the secondary stream using a secondary HC refining step to produce a partially refined pulp, treating the primary stream with alkaline-peroxide liquor to produce a treated pulp, removing the latency of the partially refined pulp and the treated pulp in a common location, and processing the partially treated pulp, and the treated pulp by one or more than one second low consistency refining step to produce a final pulp.

Pretreated wood material may include hardwood or softwood that has been reduced in size, for example, chipped, fiberized into fiber bundles, or processed using methods known in the art to reduce its size to permit handling, and processing. Pretreated wood material may also include hardwood or softwood that has been treated by for example with steam, or chemically pretreated as known in the art (see for example US 2009/0032207, US 2008/0035286, U.S. Pat. No. 6,743,332 which are incorporated herein by reference). The wood material may be from softwood such as wood from coniferous trees, for example but not limited to, spruce, pine, fir, and larch, or hardwood such as but not limited to, aspen, oak, maple, birch or eucalyptus.

The process described below reduces the electrical energy consumption in pulping, for example TMP and/or CTMP, when compared with a process involving primary high consistency refining and secondary high consistency refining, followed by low consistency refining, and has the advantage of significantly reducing, from 10-30%, the specific energy demand during thermomechanical paper-grade pulping of wood material such as for example, but not limited to, softwood material. Electrical energy savings may be gained through the increased use of one or more low consistency (LC) refining steps, by chemically treating the pulp with alkaline peroxide prior to LC refining and reducing the extent of HC refining by either removing a step of secondary HC refining, or by reducing the volume of pulp directed to secondary HC refining. More specific energy can be put into low-consistency refining, reducing the energy demand (resulting from high friction losses) required for high-consistency refining. Furthermore, treatment of TMP and/or CTMP with alkaline peroxide before one or more LC refining steps may permit the complete or partial replacement of a high-consistency secondary stage refiner. By using one HC refining step, the process comprising an alkaline peroxide treatment step before an LC refining step, further reduce the energy consumption needed for refining pulp.

Alkaline treatment also increases fiber resistance to cutting and/or decreases specific energy required to achieve desired pulp quality. The alkaline peroxide treatment step also modifies fiber properties and/or promotes fiber development during low consistency refining to produce higher quality paper, and further energy savings may be obtained. Without wishing to be bound by theory, it is believed that the alkaline peroxide treated fibers are more flexible and resist the cutting effect during extensive low-consistency refining. Furthermore, fiber water retention also improves after low-consistency refining, and the acid group content on treated fiber increases with addition of increased peroxide to maximize tensile strength of low-consistency refined fiber.

Therefore, the present invention also provides a method of decreasing energy requirement during high consistency refining of thermomechanical and chemi-thermomechanical pulp comprising, processing a pretreated wood material using one high consistency refining step to produce a first pulp, optionally applying a chelating agent to the first pulp during HC refining to produce a stabilized pulp, treating the first or stabilized pulp with an alkaline-peroxide liquor to produce a treated pulp, removing latency of the treated pulp and processing the treated pulp using one or more than one low consistency refining step to produce the final pulp.

The process as described herein comprises a step of alkaline peroxide treatment, which requires an addition of caustic soda, or other base, to fiber of up to 7.0% by weight, for example from about 1-7% caustic soda or other base (wt/wt), or any amount therebetween, from about 1-4% caustic soda or other base (wt/wt), or any amount therebetween, or 4% caustic soda or other base (wt/wt). The amount of caustic soda or other base added will depend on the pH of pulp required and the amount of recycling of whitewater back to the pulp mill.

The amount of peroxide added on fiber is of up to about 4.0% by weight, for example from about 1-4% peroxide (wt/wt), or any amount therebetween. The amount of peroxide added will depend on the brightness versus strength targets of fiber after low-consistency refining.

In the present method, pretreated wood material may be subjected to one refining step or stage to produce a first pulp. The first refining stage may involve processing using one or more high consistency refiner, for example a primary HCR, or in some instances, a primary and secondary HCR. HC refined pulp typically has a consistency of about 20% to about 45%. An optional medium consistency refining (MCR) step might be applied to the pulp obtained from the HC refinement step. The MCR processes a thick stock pulp slurry of wood chips, pre-conditioned cellulosic fibers, or other comminuted cellulosic material, having a pulp consistency in a range from about 5% to about 14% consistency. In contrast, low consistency refining (LCR) conventionally process a liquid pulp slurry having a consistency of typically below about 5%.

During the refining of wood material (e.g., wood chips) some of the wood fibers become distorted (twisted, kinked, or curled). Removal of latency may be required for effective screening of the pulp, and production of pulp paper products having desired properties. Latency removal may be effected by passing the pulp to a latency chest prior to LC refining. In the latency chest, pulp is agitated at a consistency of about 1.25-2% in a temperature range generally between about 70° C.-90° C., for twenty or thirty minutes or more.

Figure 17:
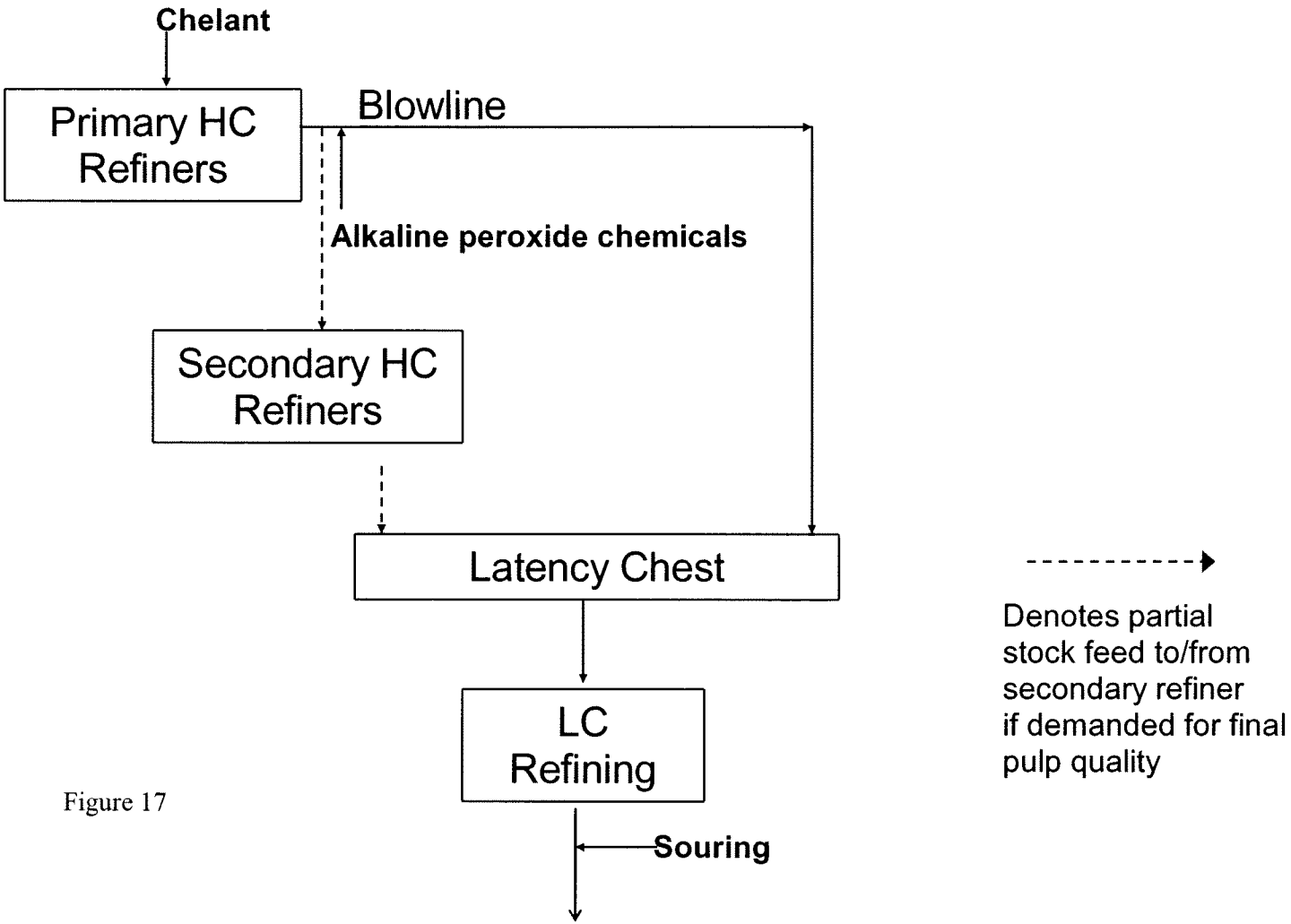
FIG. 17 shows a flow chart of an embodiment of the present process.

The process as described herein may therefore include a latency removal step (see FIG. 17). For example, the alkaline peroxide treatment of the first pulp is performed prior to a latency removal step. The alkaline peroxide treated pulped might be further treated by one or more additional refinement steps. For example, the additional or second refinement step might be a low consistency (LC) refinement step. Low consistency (LC) refining, also known as post-refining, generally takes place after the first pulp is screened and cleaned and on route to the paper machine.

Further refining steps might included neutralization of the alkalinity and/or peroxide in the pulp prior or after LC refinement by adding acid, for example, $H_2SO_4$. FIG. 17 indicates this as 'Souring Chemicals'.

The alkaline peroxide treatment stage described above may be preceded by a pre-treatment process, as is common in the art, for the removal of a significant proportion of the transition metal ions, including manganese and iron, which are present in varying concentrations in the pulp. The chelator may be added across the pH range used herein. The use of a chelating agent improves brightness, and reduces peroxide usage. The wood material may be washed and chelated with a chelating agent such as for example diethylene triamine pentaacetic acid (DTPA), (2-hydroxyethyl)ethylenediaminetriacetic acid (HEDTA), nitrilotriacetic acid (NTA), sodium tripolyphosphate (STPP), phosphonic acids and phosphonates and other compounds known in the art that chelate and help to reduce or eliminate metallic ions detrimental to the process. Alternatively, the chelating agent may be added during the step of alkaline peroxide treatment. The chelating agent may be added from 0 to about 5% (wt/wt) or any amount therebetween, for example from about 0.1 to 0.3% (wt/wt) or any amount therebetween.

One or more stabilizing agent may also be added during the alkaline-peroxide treatment step. Some metallic ions catalyze decomposition reactions of the peroxide compounds including manganese, iron, and copper. One or a combination of the following ancillary chemicals may be used to stabilize the pulp prior to or during low-consistency refining. including but are not limited to, sodium silicate, magnesium sulfate, aminopolycarboxylic acids, phosphonic acids, polycarboxylic acids, polyacrylates, polyaspartates, gluconates and/or citrates.

Therefore, the present invention provides a process (A) for producing TMP and/or CTMP comprising:

(a) processing pretreated wood material by at least one high consistency (HC) refining step to produce a first pulp;

(b) optionally applying a chelating agent to the first pulp during HC refining to produce a stabilized pulp;

(c) treating the stabilized or first pulp with an alkaline-peroxide liquor to produce a treated pulp;

(d) removing latency of the treated pulp; and (e) processing the treated pulp by one or more second refining steps to produce a final pulp.

The consistency of the first, the stabilized, and the treated pulp, or any of the first, the stabilized and treated pulp may be higher than the consistency of the second pulp.

The present invention includes the process (A) as described above, wherein the at least one refining step consists of a primary high consistency refiner. For example, in the at least one refining step, a primary high consistency refiner may be used in the absence of a secondary high consistency refiner, or a medium consistency refiner (see FIG. 17). By by-passing the secondary HC refining step, energy savings are obtained.

Furthermore, the present invention includes the process as described above, wherein the at least one refining step does not comprise a screening step.

The present invention also provides a process (B) for producing mechanical or thermomechanical pulp comprising:

(a) processing a pretreated wood material using one high consistency (HC) refining step to produce a first pulp;

(b) optionally applying a chelating agent to the first pulp during HC refining to produce a stabilized pulp (c) dividing the first pulp or stabilized pulp into a primary and a secondary stream;

(d) processing the secondary stream using a secondary HC refining step to produce a partially refined pulp;

(e) treating the primary stream with alkaline-peroxide liquor to produce a treated pulp;

(f) removing the latency of the partially refined pulp and the treated pulp in a common location; and (g) processing the partially treated pulp, and the treated pulp by one or more than one second low consistency refining step to produce a second pulp.

In the process (B) defined above, a volume of pulp in the secondary stream that is processed by the secondary high consistency refiner is reduced when compared to a process where the first pulp directly enters the secondary high consistency refiner. In method (B), a volume of first pulp by-passes the secondary HC refiner and proceeds directly to alkaline peroxide treatment, thereby reducing the energy demand of the secondary HR refiner. The volume of first pulp entering the secondary HC refiner via the secondary stream may be from about 0 to about 75%, of the volume of primary stream that is directly processed by alkaline pretreatment, or any volume therebetween, for example from about 5 to about 50% of the volume of primary stream directly processed by alkaline pretreatment, or any volume therebetween, for example 25-40% of the volume of primary stream directly processed by alkaline pretreatment, or any volume therebetween, or for example 5, 10, 15, 20, 25, 30, 35, 40, 45, 50, 55, 60, 65, 70, 75% of the volume of primary stream directly processed by alkaline pretreatment, or any volume therebetween.

Dividing the stream obtained following primary high consistency refining, and diverting a portion of this stream directly to alkaline peroxide treatment (the primary stream), reduces the amount of pulp being processed by secondary high consistency refining (the secondary stream), and achieves additional energy savings due to the reduced volume of pulp entering secondary high consistency refining. The portion of the pulp diverted directly to alkaline peroxide treatment via the primary stream, and that by-passes secondary high consistency refining, may be from about 25 to about 100% of the volume of secondary stream directed to the secondary HC refiner, or any volume therebetween, for example 60-75% of the volume of secondary stream directed to the secondary HC refiner, or any volume therebetween, or 25, 30, 35, 40, 45, 50, 55, 60, 65, 70, 75, 80, 85, 90, 95, or 100% of the volume of secondary stream directed to the secondary HC refiner, or any volume therebetween.

Furthermore, in either of the processes (A) or (B) described above, more than one second refining step, for example, a step of low consistency refining, may be used to achieve the desired freeness and quality of the second pulp. With this method, energy is diverted from a second energy intensive step of HC refining, to additional steps of LC refining which, due to a reduced consistency of pulp, and flexibility of the alkaline treated pulp consume less energy.

By the term "consistency" is meant the percentage of bone dry solids by weight in pulp or stock. A high consistency pulp generally has a consistency of about 15% or higher. A medium consistency pulp generally has a consistency of about 5% to about 15%. A low consistency pulp generally has a consistency of less then about 5%.

For example, the first pulp may have a consistency from about 10% to about 45%, or any amount therebetween, for example 10, 15, 20, 25, 30, 35, 40 or 45% or any value therebetween, the first pulp may have a consistency of about 15%.

The treated pulp has a consistency from about 5% to about 15%, such as 5, 10 or 15, or any value therebetween, for example, the treated pulp has a consistency of 10%.

The second pulp may have a consistency from about 0.5% to about 5%, or any amount therebetween, such as 1%, 2%, 2.1%, 2.2%, 2.3%, 2.4%, 2.5%, 2.6%, 2.7%, 2.8%, 2.9%, 3%, 3.1%, 3.2%, 3.3%, 3.4%, 3.5%, 3.6%, 3.7%, 3.8%, 3.9%, 4%, 4.1%, 4.2%, 4.3%, 4.4% or 4.5% or any value therebetween for example, the second pulp may have a consistency of about 2.4% to about 4%.

By the term "alkaline-peroxide treatment" is meant a treatment with an alkaline peroxide liquor (also referred to as alkaline peroxide) comprising hydrogen peroxide or some other inorganic peroxide compound such as sodium perborate, sodium perphosphate, sodium percarbonate or sodium persulfate. The alakline peroxide bleach liquor may also include a peroxide stabilizer containing for example an alkaline earth metal (i.e. magnesium and/or calcium) and a base. The pH of the alkaline peroxide bleach liquor is adjusted with a combination of alkalies, including but not limited to, soda ash, sodium carbonate (Na2CO3), sodium bicarbonate (NaHCO3), magnesium oxide, magnesium hydroxide and sodium hydroxide (NaOH; caustic soda) to give a pH of at least about 11 to at least about 13 or any value therebetween, for example a pH of 11, 11.5, 12, 12.5 or 13, or any amount therebetween. The peroxide liquor will generally contain from 0-6% (wt/wt on fiber), or any amount therebetween hydrogen peroxide, for example 0, 0.5, 1, 1.5, 2, 2.5, 3, 3.5, 4, 4.5, 5, 5.5 or 6% (wt/wt on fiber) hydrogen peroxide, or any value therebetween, for example 4% (wt/wt on fiber). The hydrogen peroxide concentration in liquor may also be 4-8% (v/v). The peroxide liquor may also comprise an equivalent amount of some other inorganic compound, for example, from 0-3% (wt/wt on fiber), or any amount therebetween of a sodium silicate solution ($Na_2SiO_3$), and from 0-0.5% (wt/wt on fiber), or any amount therebetween of a stabilizer agent.

The sodium hydroxide, or other base, concentration may range from about 0% to about 7% (wt/wt on fiber), or any amount therebetween, such as 1, 2, 3, 4, 4.3, 4.4, 4.5, 4.6, 4.7, 4.8, 4.9, 5, 5.5, 6, 6.5 or 7% (w/w) or any value therebetween, for example, the sodium hydroxide concentration may be 4.4% (w/w) or 6% (w/w). The alkaline peroxide bleach liquor may comprises caustic soda as an alkali source. The caustic soda concentration may range from 0% to about 7% (w/w), or any amount therebetween, such as 1, 2, 2.5, 3, 3.5, 4, 4.5, 5, 5.5, 6, 6.5 or 7% (wt/wt on fiber) or any value therebetween, for example, the caustic soda concentration may be 2.5% (wt/wt on fiber) or 6% (wt/wt on fiber).

The stabilized pulp, or first pulp, is treated with the alkaline peroxide (alkaline peroxide bleaching liquor) at a temperature from about 40° C. to about 75° C., or any temperature therebetween, for example, 40, 45, 50, 55, 60, 65, 70 or 75° C., or any value therebetween, for example, the temperature may be about 60° C. or about 75° C.

The duration of the alkaline peroxide treatment step is between 0.5 and about 5 hours, or any amount therebetween, such as 5 min, 10 min, 15 min, 20 min, 30, min, 40 min, 50 min, 1, 1.5, 2, 2.5, 3, 3.5, 4, 4.5 or 5 hours, or any value therebetween, for example, about 10 min to about 1 hour, or any value therebetween.

It has been found that the present process of alkaline-peroxide treatment of the TMP and/or CTMP after a primary HC refining stage and prior to LC refining has the advantage of significantly reducing specific energy demand during thermomechanical paper-grade pulping of wood material. In one embodiment the specific energy demand has been reduced by from about 5% to about 40%, such as from about 10%, 15%, 20%, 25%, 30% or 35%, or any value therebetween, when compared to a process that involves the use of two HC refining stages (i.e. a primary and secondary stages). For example, to achieve a given tensile, a combination of alkaline peroxide plus low consistency refining may reduce electrical energy consumption by around 900 kWh/t.

As described in the examples below, treatment of a first pulp with alkaline peroxide prior to low consistency refining provides an increase in tensile strength index from about 10 Nm/g to about 20 Nm/g, or any amount therebetween, such as 10, 12, 14, 15, 19 or 20 Nm/g or any value therebetween, when compared to a control, for example, the tensile strength index is increased by 16 Nm/g, when compared to a control (non-alkaline peroxide treated pulp).

The alkaline treated pulp also is characterized an having increased brightness of from about 5 ISO points to about 15 ISO points, or any amount therebetween, when compared to a control, for example, the brightness may increase by 10 ISO points, when compared to a control.

The alkaline peroxide treated pulp may also be more resistant to cutting in LCR due to increased fiber flexibility compared to control pulp.

The present invention will be further illustrated in the following examples. However it is to be understood that these examples are for illustrative purposes only, and should not be used to limit the scope of the present invention in any manner.

EXAMPLE 1

Materials

The pulp used for the validation of the laboratory simulation of LC refining was a thermomechanical pulp (TMP) prepared from whole log hemlock wood chips in the Andritz pilot plant, Springfield, Ohio. The pulp used for alkaline peroxide treatments was a second-stage outlet TMP made from a mixture of pine, hemlock, and spruce chips in the Elk Falls mill of Catalyst Papers. The freeness values of the pulps used for simulation and alkaline peroxide treatments were 168 ml CSF and 137 ml CSF respectively.

Refining

Pilot plant LC refining was conducted using a 22" Andritz TwinFlow pilot refiner at 4% consistency with 90 kWh/t of specific energy per pass from tank to tank at Andritz pilot plant.

Refining with the "Waring Blendor" used a blender with a 1 L capacity bowl. A 500 mL suspension of pulp at 2.4% consistency was blended in the blender for 10, 20, 30 or 40 minutes at 115 V and 1.9 A.

Refining with a PFI mill followed the PAPTAC method C.7 except in that the pulps, 240 g at 4% consistency, were loaded into a PFI mill set at a 0.2 mm gap.

Alkaline Peroxide Treatment

The washed pulps (30 g oven-dry) were chelated with 0.2% diethylene triamine pentaacetic acid (DTPA) at 4% consistency and 60° C. for 30 min. After chelation, the pulps were washed with deionized water and then dewatered to around 20% consistency. The pulps were put into plastic bags and mixed with bleaching liquor at 15% consistency before incubating in a water bath at 60° C. for 2 hours with occasional mixing. Chemical charges were 0.1% magnesium sulfate ($MgSO_4$), 3% sodium silicate ($Na_2SiO_3$), 0-4% hydrogen peroxide ($H_2O_2$) based on O.D. pulp, and sufficient sodium hydroxide (NaOH) to give an initial liquor pH of 11, 12 or 13 (Table 1). The treated pulps were washed with deionized water with filtrate recycle to retain fines. Yield was calculated from the pulp mass difference before and after the treatments.

TABLE 1

SODIUM HYDROXIDE CHARGES USED TO OBTAIN THE DESIRED INITIAL pH (BASED ON O.D. PULP)

| Initial liquor | Amounts of NaOH charged | | |
|---|---|---|---|
| pH | 0% $H_2O_2$ | 2% $H_2O_2$ | 4% $H_2O_2$ |
| pH 11 | 0.11% | 0.57% | 0.63% |
| pH 12 | 0.28% | 2.11% | 3.03% |
| pH 13 | 1.03% | 4.43% | 6.00% |

Pulp Freeness

Freeness of the pulps was determined according to PAPTAC standard method Cl. Pulps were hot disintegrated to remove latency prior to freeness measurements and handsheet preparation.

Handsheet Properties

Handsheets were made according to PAPTAC method C.4. White water was recycled during handsheet making Bulk, brightness, tensile strength and tear resistance were determined according to PAPTAC standards D.4, D.12, D.6H, and D.9 respectively.

Fiber Length

Fiber length of the pulp was determined using a Fiber Quality Analyzer (FQA) according to manufacturer's instructions. The Fiber Quality Analyzer was set such that fragments less than 0.07 mm were not included in the calculation of the mean fiber lengths. Fiber lengths are reported as length weighted means. For the calculation of fiber distribution, long fibers were defined as the fibers longer than 1.7 mm, while short fibers were those shorter than 0.25 mm The long and short fibers of the pulp in this study were roughly equivalent to R28 and P100 of the Bauer-McNett fractions respectively.

Water Retention Value

Water Retention value (WRV) determination was conducted on the whole pulps according to Tappi method UM256. B.

Acid Group Content

Amounts of acid groups in pulps were determined using the method of conductometric titration described by Beatson [5].

Fiber Flexibility.

The method of Steadman and Luner was followed [6]. The pulp used was collect from the P14/R28 section of a Bauer-McNett classifier. The median fiber flexibility was calculated from measurements on sixty fibers.

Statistics

The data points in the figures are means of measurements. The measurements are duplicated unless specified. Error bars in all graphs refer to 95% Significant Confidence intervals.

EXAMPLE 2

Validation of the LC Refining Simulation with a Blender

In order to efficiently evaluate the effects of various alkaline peroxide treatments on TMP before and after LC refining in the laboratory, it was necessary to find a suitable laboratory scale device that could mimic LC refining. Previously, Shaw [7] found that a blender with a one gallon container could mimic the second-stage HC refiner in thermomechanical pulping. More recently, French and Maddern [8] were able to mimic a high shear low load refiner using a "Waring Blendor" with a one litre container. Based on these previous studies, the possibility was explored of using the "Waring Blendor" to mimic a low consistency refiner. It was determined that when 500 mL of pulp at 2.4% consistency was refined for 10 minutes in a 1 litre "Waring Blendor" the freeness drop and tensile gain were similar to those obtained when the same pulp was refined in the LC refiner in the mill at a specific energy of 100 kWh/t. To further validate the laboratory refining process, TMP was refined in a 22" Andritz TwinFlow pilot refiner at 4% consistency and 90 kWh/t of specific energy per pass and the resulting pulp properties were compared to those obtained when the same pulp was refined in the blender.

As seen in FIG. 1, both freeness and fiber length decrease with refining for both processes. It is apparent that 10 minutes of blending develops the fiber properties somewhat more than the application of 90 kWh/t in the refiner. Indeed for freeness development, it appears that 10 minutes of blending corresponds to around 110 kWh/t in the refiner. Fiber length is a little higher at a given freeness for pulp refined in the blender. Reduced fiber cutting in the blender is consistent with Shaw's conclusion that the blender acts as a low intensity refiner [7].

Table 2 compares the effects of blending for 10 minutes per stage with pilot mill LC refining at 90 kWh/t of specific energy per stage on handsheet properties. The reductions in bulk and tear are similar. However, tensile strength is developed more slowly in the refiner, with approximately 150 kWh/t being required to produce similar tensile gains as were obtained through 10 minutes of blending. Apparently, for a given drop in bulk, tensile strength was developed to a greater extent in the blender than in the pilot refiner. This may be related to better retention of fiber length (FIG. 1).

TABLE 2

HANDSHEET PROPERTIES OBTAINED ON REFINING
BLENDING - 10 MIN PER STAGE; PILOT LC REFINING - 90 kWh/t PER STAGE

| Refining | Tensile index (Nm/g) | | Bulk ($cm^3/g$) | | Tear index ($mNm^2/g$) | |
|---|---|---|---|---|---|---|
| stage | Blending | LC refining | Blending | LC refining | Blending | LC refining |
| Control | 33.79 ± 1.24 | 33.79 ± 1.24 | 3.13 ± 0.01 | 3.13 ± 0.01 | 8.92 ± 0.39 | 8.92 ± 0.39 |
| 1 | 38.10 ± 1.05 | 35.47 ± 0.92 | 2.96 ± 0.02 | 3.00 ± 0.02 | 9.09 ± 0.54 | 8.42 ± 0.57 |
| 2 | 42.00 ± 0.88 | 39.00 ± 0.39 | 2.82 ± 0.03 | 2.83 ± 0.02 | 8.87 ± 0.47 | 8.37 ± 0.47 |
| 3 | 43.39 ± 1.12 | 41.21 ± 1.12 | 2.77 ± 0.02 | 2.73 ± 0.02 | 7.89 ± 0.25 | 7.79 ± 0.34 |
| 4 | 45.05 ± 1.04 | 41.65 ± 1.94 | 2.70 ± 0.02 | 2.68 ± 0.02 | 7.58 ± 0.13 | 7.45 ± 0.32 |

From the comparison of the results from blending with the results from mill and pilot refining, it is apparent that the "Waring Blendor", operated at 2.4% consistency, can mimic low consistency refining, with 10 minutes of blending producing similar effects to the application of 110 to 150 kWh/t of specific energy in the full scale LC refiner.

EXAMPLE 3

Effects of Alkali Peroxide Treatment on TMP Properties and Response to LC Refining Based on the above findings, the "Waring Blendor" was used to examine the effects of alkaline peroxide treatments on the response of TMP to subsequent LC refining. A second-stage TMP, HC refined to 137 mL freeness, was treated with different combinations of sodium hydroxide and hydrogen peroxide (Table 1) before being blended for 10 min. As discussed in Example 2, the blending corresponds to the application of 110 to 150 kWh/t specific energy at a pilot scale. The properties of the alkaline peroxide treated pulps were tested before and after blending. Yield losses were a maximum of 4% at the higher alkali charges [9].

Handsheet Properties

Tensile Strength

Figure 2:
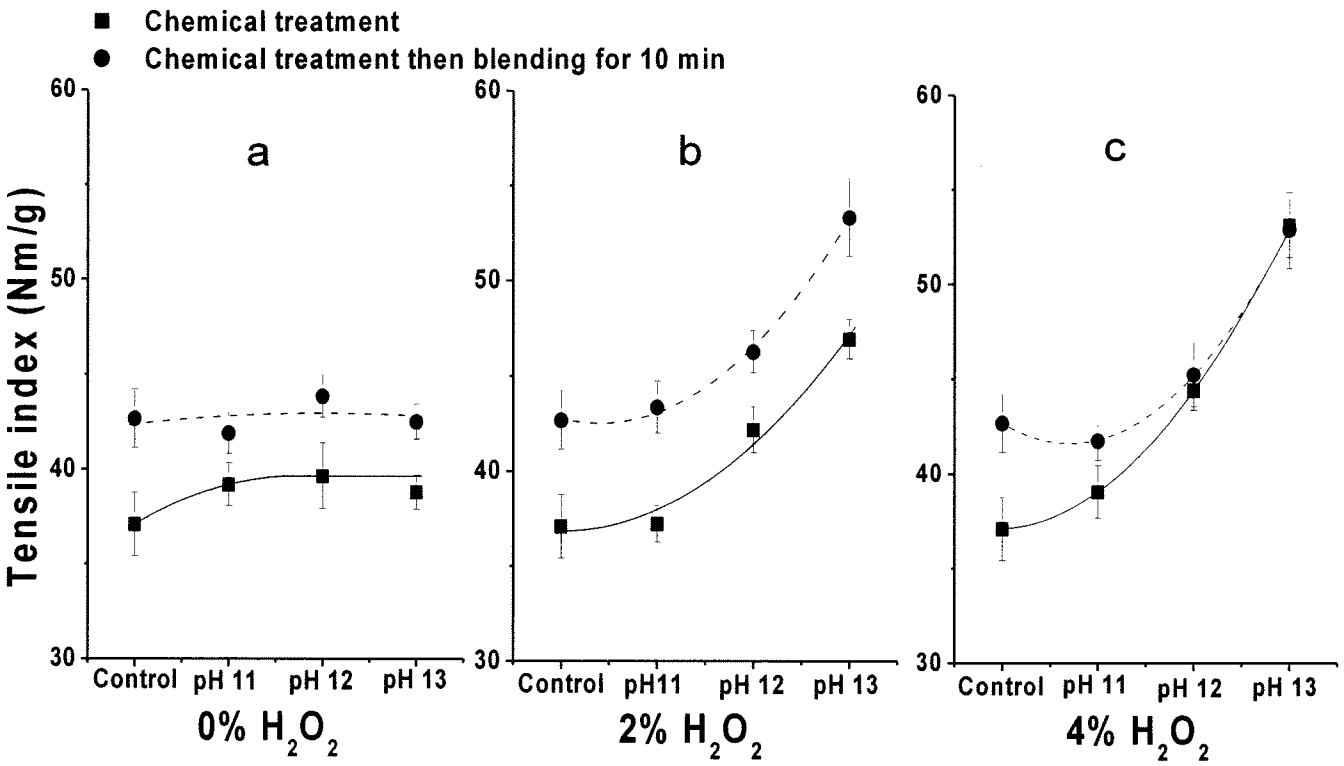
FIG. 2 shows a graph of the effect of different $H_2O_2$ concentrations (FIG. 2*a*=0% $H_2O_2$; 2*b*=2% $H_2O_2$ and 2*c*=4% $H_2O_2$) and pH values on the tensile index (Nm/g) Alkaline peroxide treatments improve tensile strength. Subsequent LC refining increases the tensile strength of pulps treated at lower alkalinity (alkali charges see Table 1).
Figure 3:
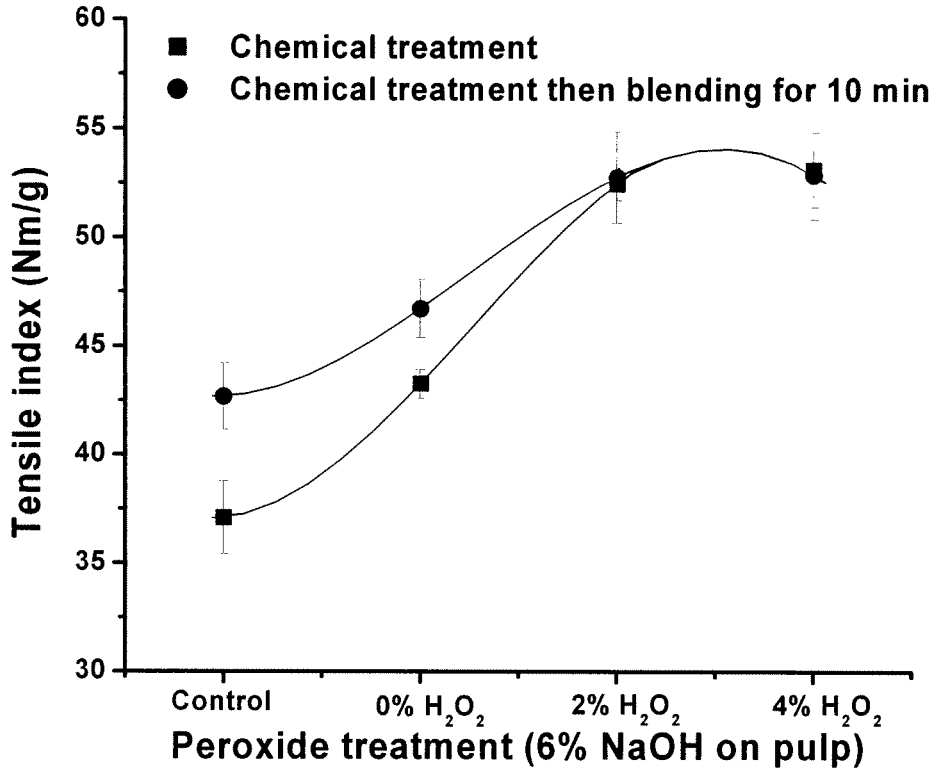
FIG. 3 shows a graph of tensile index (Nm/g) at different $H_2O_2$ concentrations. At high alkalinity, peroxide charges of 2% and 4% give equivalent tensile gains. No further increase in tensile was obtain when these pulps were refined.

FIG. 2 shows that both alkali and hydrogen peroxide increased the tensile strength of the TMP prior to LC refining. For a given peroxide charge, tensile strength increased significantly with increasing initial pH above pH 12, which is similar with Moldenius' observation [2]. For the same high alkali charge (6% NaOH plus 3% $Na_2SiO_3$), tensile strengths of the pulps treated with 2% or 4% peroxide were not significantly different from each other but they were 23% higher than that of the pulp treated with alkali alone (FIG. 3). These results are consistent with Korpela's [10] work on alkaline peroxide treatment of stone groundwood where he found that fiber bonding was more dependent upon alkalinity than peroxide charge.

The tensile gains on refining were the same for treatments conducted at low alkali charge (FIG. 2). At high alkali charge in the presence of peroxide (FIGS. 2*c* & 3), no additional tensile gain was obtained through subsequent LC refining. Although highly alkaline peroxide treatments increased the pulp tensile strength, they did not promote the further fibrillation during LC refining. It should be noted that these treatments were done on well developed pulp already refined to 137 mL freeness through high consistency refining in the mill. It is quite possible that the highly alkaline treatments would promote fiber development for a higher freeness pulp. The 15 Nm/g of tensile strength enhancement obtained by the treatment using 2-4% $H_2O_2$ and 6% NaOH (FIG. 3) would require the application of approximately 550 kWh/t of electrical energy in second stage HC refining. Thus, it is apparent that these chemical treatments could lead to significant savings in electrical energy to a given tensile strength.

Tear Strength

Figure 4:
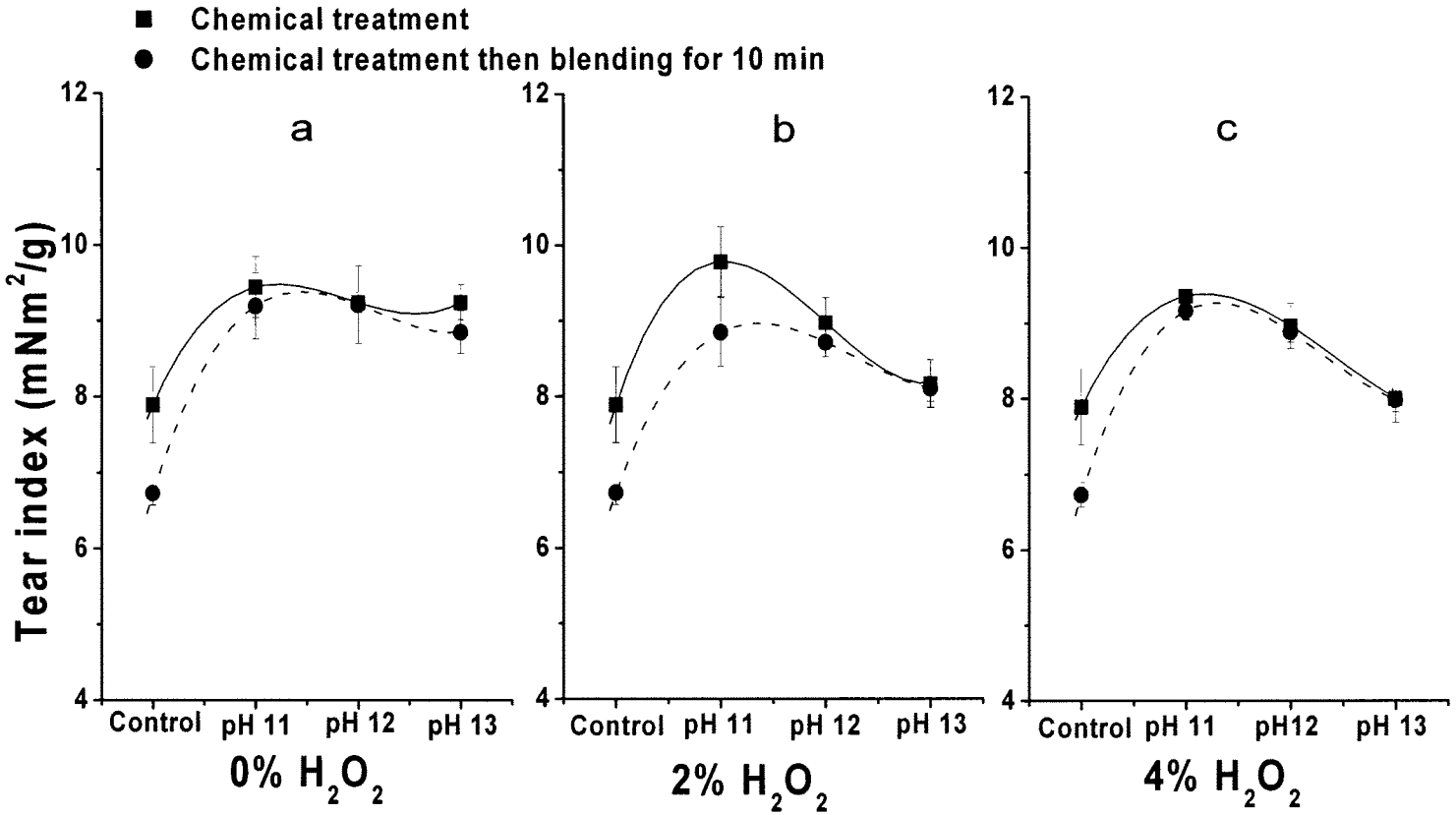
FIG. 4 shows a graph of tear index (mNm2/g) at different $H_2O_2$ concentrations (FIGS. 4*a*=0% $H_2O_2$; 4*b*=2% $H_2O_2$ and 4*c*=4% $H_2O_2$) and pH values. The tear increases with pH of treatment to a maximum at pH 11 then falls. Blending reduces tear at lower pH values.

The development of tear strength with the alkali peroxide treatments is shown in FIG. 4. For treatments with an initial pH lower than 12, the tear strength of the pulp increased. As the pH was increased further, tear strength decreased. The decrease in tear was greatest for the peroxide treated pulps. However in all cases, the tear strength of the treated pulps was not lower than that of the original pulp. The subsequent LC refining slightly lowered the tear strength of each sample.

The general trend of an initial increase in tear followed by a decrease as the tensile increases is a well known phenomenon for mechanical pulps and is related to increased bonding and is not necessarily a reflection of fiber shortening [11, 12].

Bulk

Figure 5:
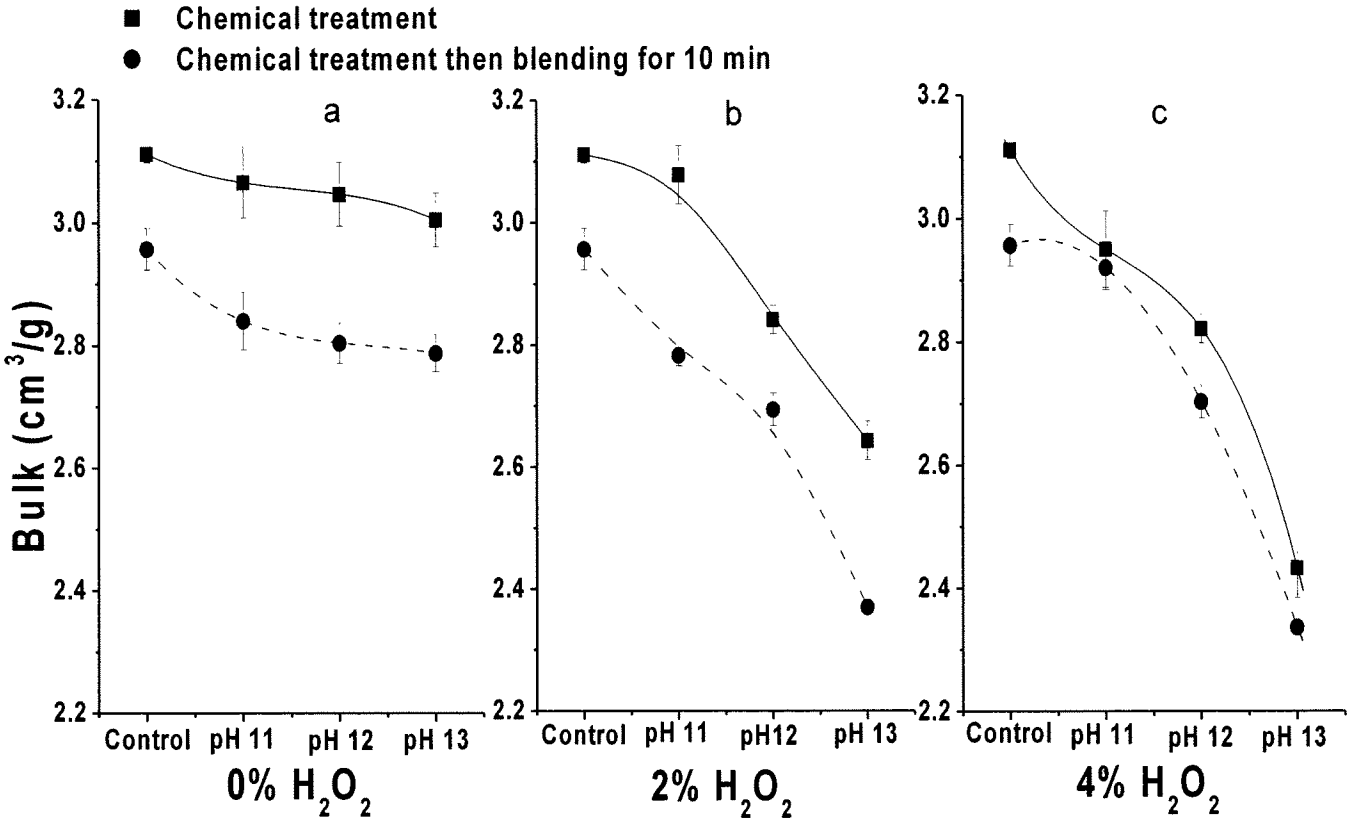
FIG. 5 shows a graph of bulk ($cm^3$/g) at different $H_2O_2$ concentrations (FIGS. 5*a*=0% $H_2O_2$; 5*b*=2% $H_2O_2$ and 5*c*=4% $H_2O_2$) and pH values. Peroxide treatments reduce handsheet bulk when compared to a control. Further bulk reductions are achieved through LC refining.

The bulk of the pulp treated by alkali peroxide developed in a similar manner to tensile strength (FIG. 5). The bulk of the pulp treated with highly alkaline peroxide (4% $H_2O_2$ and 6% NaOH) decreased from 3.11 $cm^3/g$ to 2.3 $cm^3/g$ while it did not change significantly during the subsequent LC refining. The lower bulk of the pulp treated by alkali peroxide reflects greater sheet consolidation during pressing and drying and is usually taken as an indication of greater fiber flexibility.

Brightness

Figure 6:
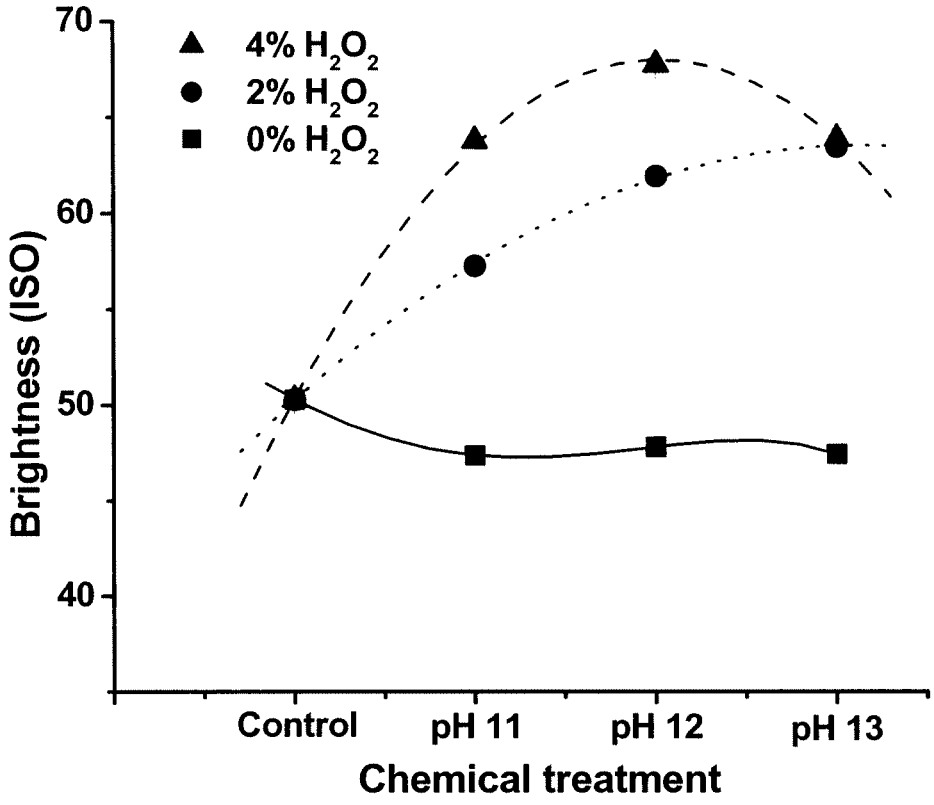
FIG. 6 shows a graph with brightness (ISO) at different pH values and $H_2O_2$ concentrations. Brightness reaches a maximum at an initial pH of 12 and 4% peroxide charge when compared to a control.

With alkali peroxide treatments, the pattern of brightness gain is different from that of the tensile strength increase (FIG. 6). For the treatments using 4% $H_2O_2$, the brightness reached a maximum at around pH 12 and then decreased as pH increased. On the other hand, the brightness of 2% $H_2O_2$ treated pulp continued to increase until pH 13. This is consistent with the conclusion that there is an optimal ratio of total alkalinity to peroxide charge for a maximum brightness gain [13]. As the peroxide charge increases, the optimum ratio decreases, resulting in a maximum brightness gain occurring at a lower pH.

Pulp Properties

Freeness

The alkali peroxide treatments did not significantly change the freeness value of the original pulp. Subsequent LC refining with the blender decreased freeness of all the pulps from around 137 ml CSF to approximately 90 ml CSF.

Water Retention Value

Figure 7:
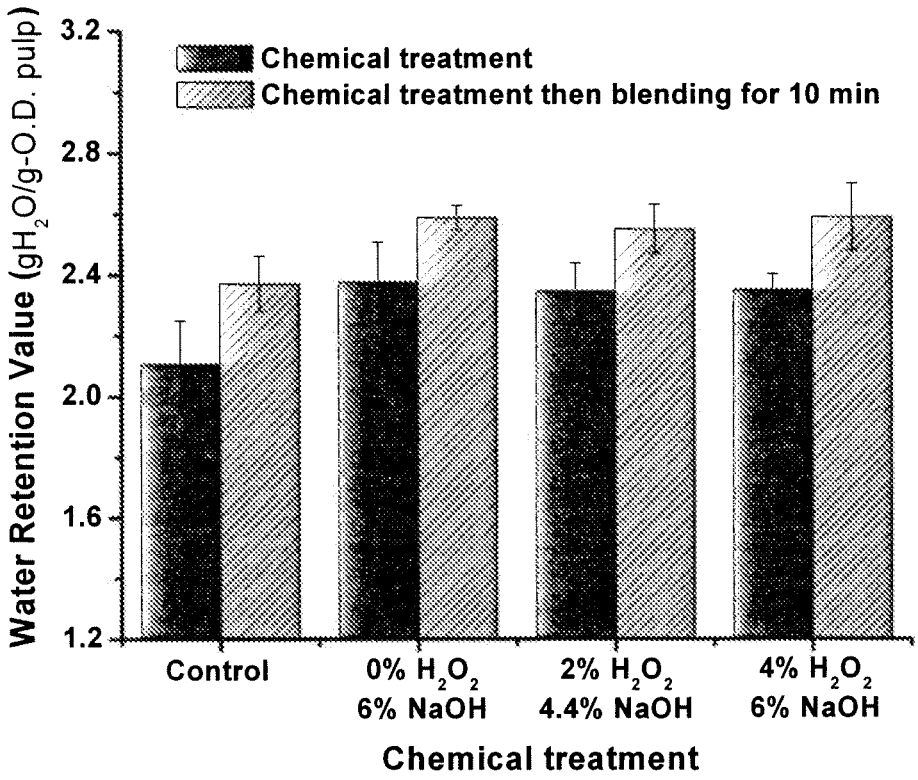
FIG. 7 shows a graph with water retention value (g$H_2O$/g-O.D. pulp) with different $H_2O_2$ and NaOH concentrations. All chemical treatments increased the water retention value (WRV) by around 14% when compared to a control. A further 9% increase was obtained on refining with the blender.

Water retention value (WRV) measurements were conducted on the pulps treated using different alkali and peroxide dosages. FIG. 7 shows that the WRV of the treated pulps increased by around 14%, independent of hydrogen peroxide and alkali charge. Subsequent LC refining increased the WRV of all the pulps by further 9%.

Figure 8:
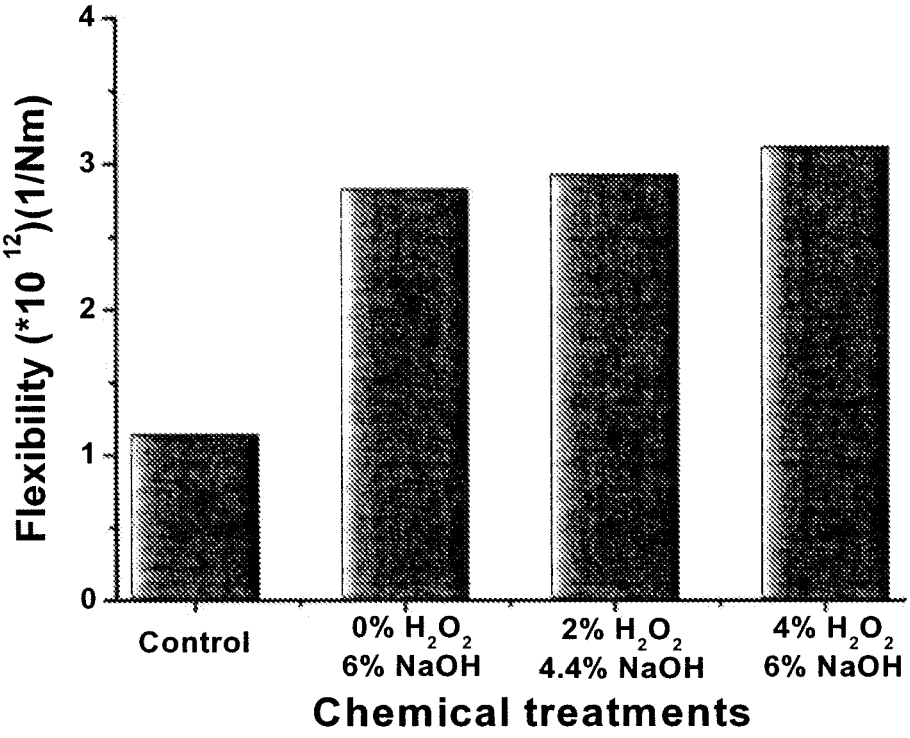
FIG. 8 shows a graph of flexibility (*$10^{12}$)(1/Nm) at different $H_2O_2$ and NaOH concentrations. Alkali with or without peroxide increases fiber flexibility.

This pattern of WRV increases is distinctly different from increases in tensile and decreases in bulk (FIGS. 2 & 5). For example, the water retention value of the pulp treated with no peroxide and 6% alkali is the same as that of the one treated with 4% peroxide and 6% alkali yet the tensile strength of the latter is 17% higher than the former. Also, refining increases the water retention values of the pulp treated with 4% peroxide and 6% alkali, yet no gain in tensile was observed. FIG. 8 shows that the fiber flexibility of the treated, but not refined fibers, follows the same pattern as the water retention values.

The lack of a relationship of WRV and fiber flexibility to tensile strength and bulk indicates that other factors are dominating. Perhaps reactions with peroxide that modify the fiber surface and/or change the quality of fines are critical for the increased tensile whereas fiber swelling is mainly caused by alkali.

Resistance of Fiber to Cutting During Refining

Figure 9:
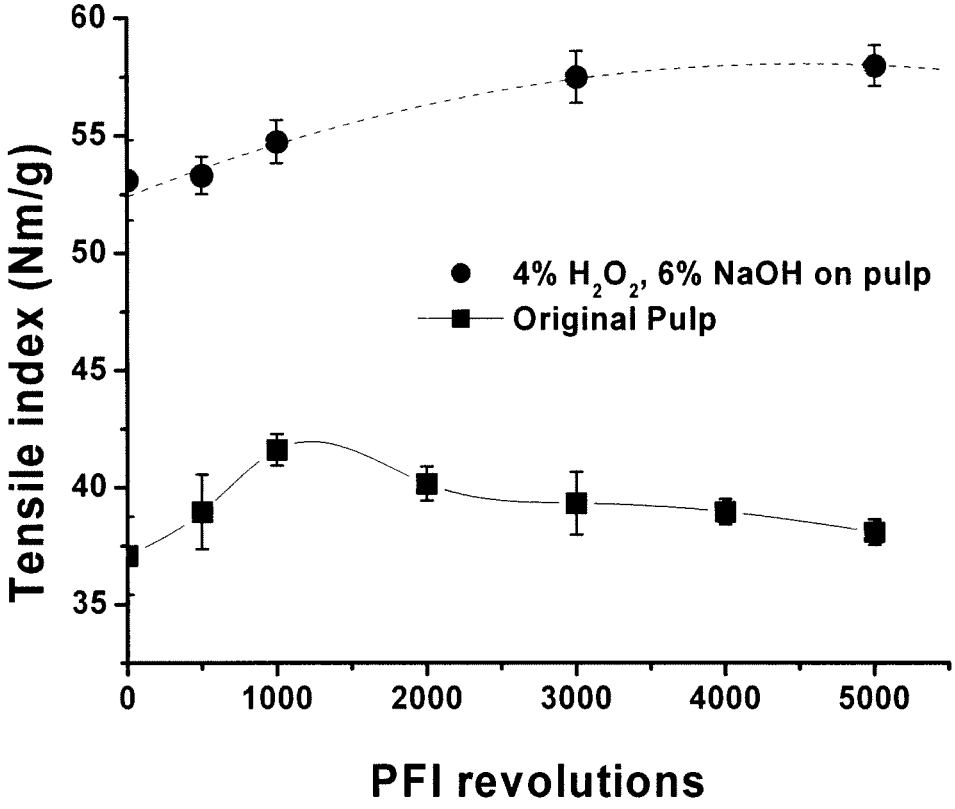
FIG. 9 shows a graph of tensile index (Nm/g) vs. PFI revolutions. Pulp treated with 4% $H_2O_2$ & 6% NaOH increases in tensile on beating to 5000 revs. whereas the original pulp looses tensile after 1000 revs.

To examine if the alkaline peroxide treatments make the fibers more resistant to cutting during refining, the original pulp and pulp treated with 4% $H_2O_2$ and 6% NaOH were refined using a PFI mill. The PFI mill has previously been shown to produce more fiber cutting than a "Waring Blendor" [8]. The results show that the original pulp quickly reached the maximum tensile strength around 1000 revolutions and then started to deteriorate with further refining (FIG. 9). On the other hand, for the 4% $H_2O_2$ treated sample, handsheet tensile strength continued to improve up to 5000 revolutions. As the PFI revolutions are increased, more energy is applied to the pulps, promoting the external and internal fibrillation of fibers, fiber flexibility and possibly fiber cutting. Increased fiber fibrillation and flexibility would increase tensile strength while fiber cutting would have the opposite effect. The observation of tensile decrease for the original pulp implies that fiber cutting is occurring whereas in the treated pulp the continuous rise in tensile implies protection of the fiber from the cutting.

Figure 10:
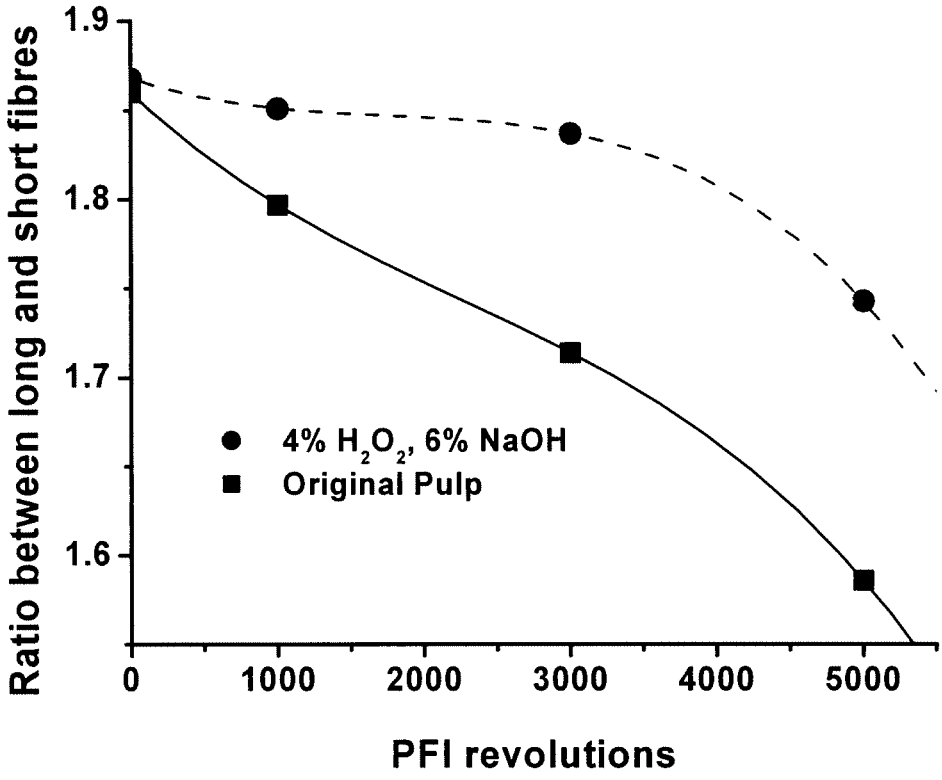
FIG. 10 shows a graph of the ratio between long and short fibers vs. PFI revolutions. Treatment of pulp with 4% $H_2O_2$ & 6% NaOH helps maintain fiber length during beating.

The protection from fiber cutting by the chemical treatment is confirmed by fiber length measurements. Fiber length measurements using the FQA show that the original sample had continuously decreasing ratios of long fiber (>1.7 mm) to short fiber (<0.25 mm) as PFI revolutions increased, while 4% $H_2O_2$ treated pulp maintained a high ratio of long to short fibers until 3000 revolutions, after which the ratio dropped rapidly (FIG. 10). The high resistance of the 4% $H_2O_2$ treated pulp to fiber cutting is likely related to its improved fiber flexibility. It may be possible to exploit this phenomenon in industrial scale LC refining where fiber cutting is known to be a problem [1]. This would open the way to increased application of LC refining and further electrical energy reduction in TMP production.

Figure 11:
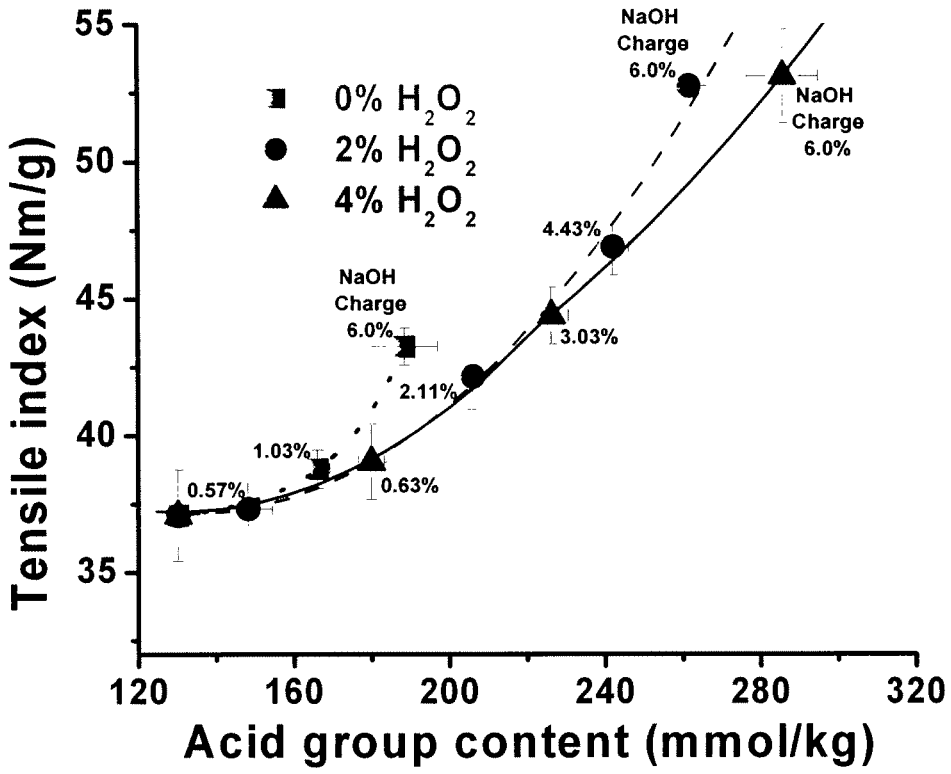
FIG. 11 shows a graph of tensile index (Nm/g) vs. Acid group content (mmol/kg). Tensile strength is correlated with acid group content.
Figure 12:
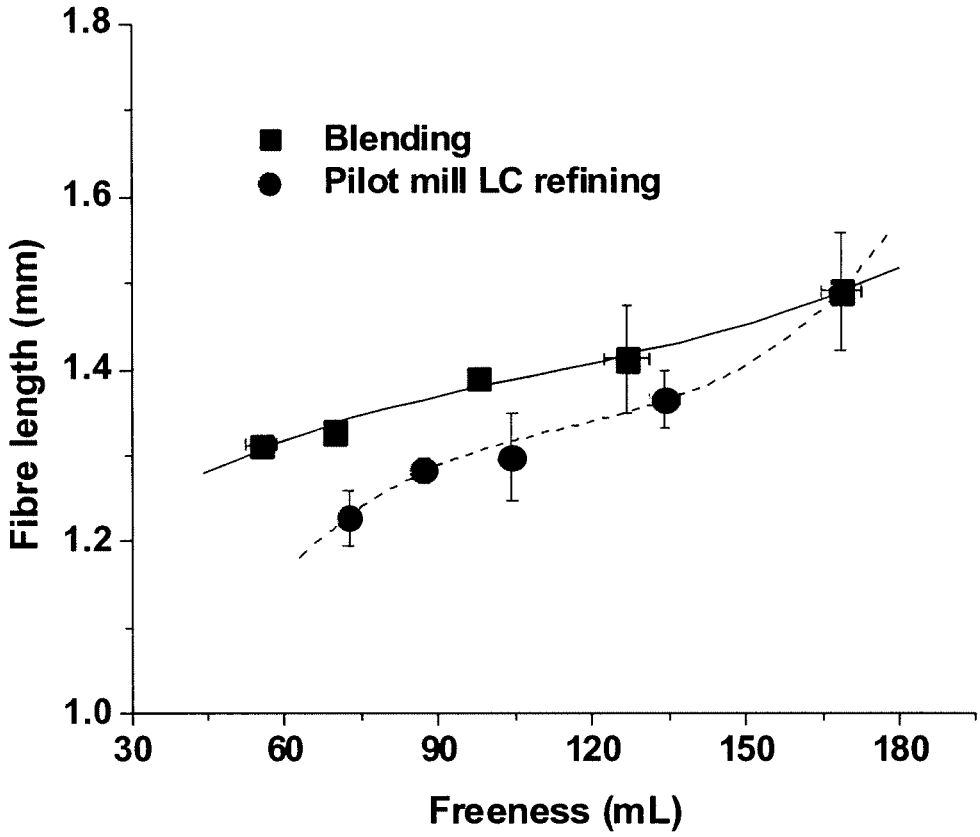
FIG. 12 shows a graph of fiber length (mm) vs. Freeness (mL) of pulp that has been blended or been LC refined in a pilot mill.
Figure 13:
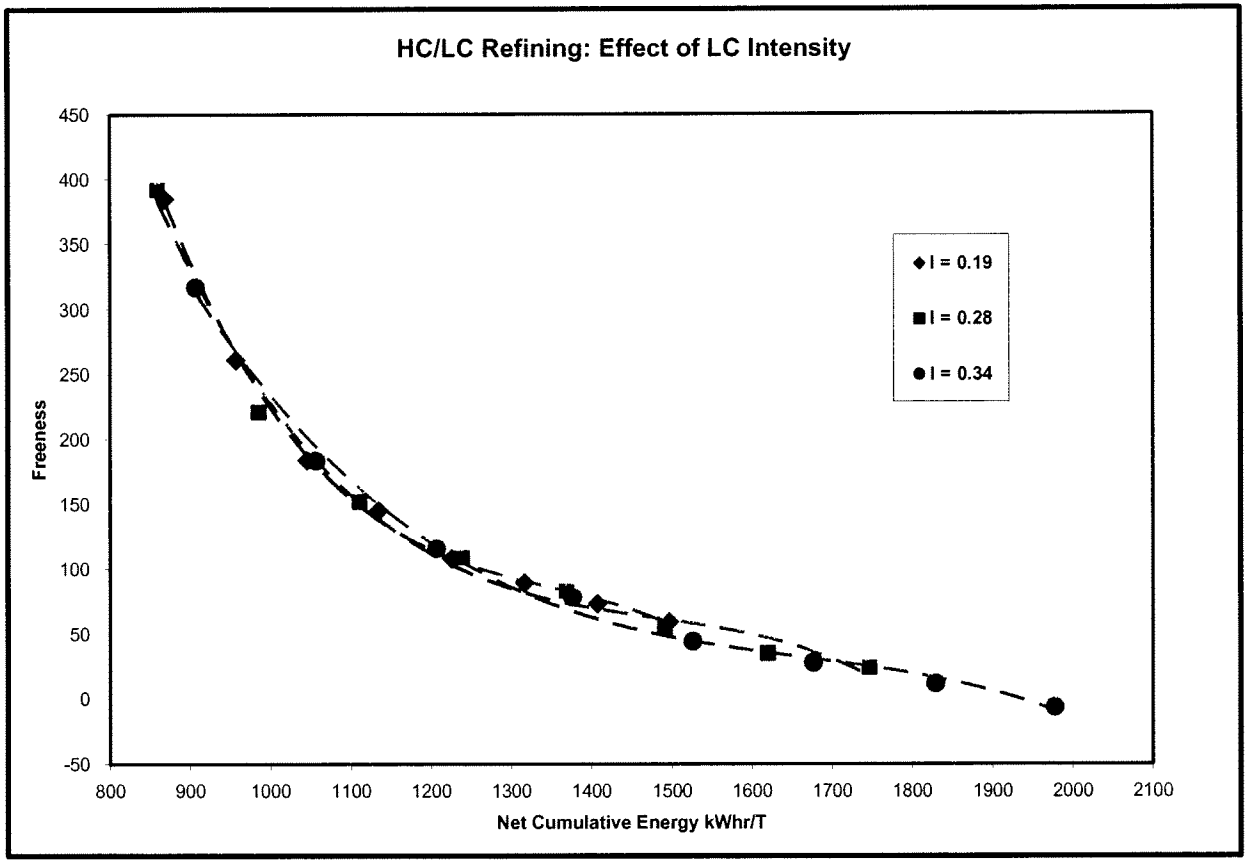
FIG. 13 shows a graph with the freeness vs. the Net cumulative Energy kWhr/T with no alkaline peroxide treatment of pulp before the LC refining step.
Figure 14:
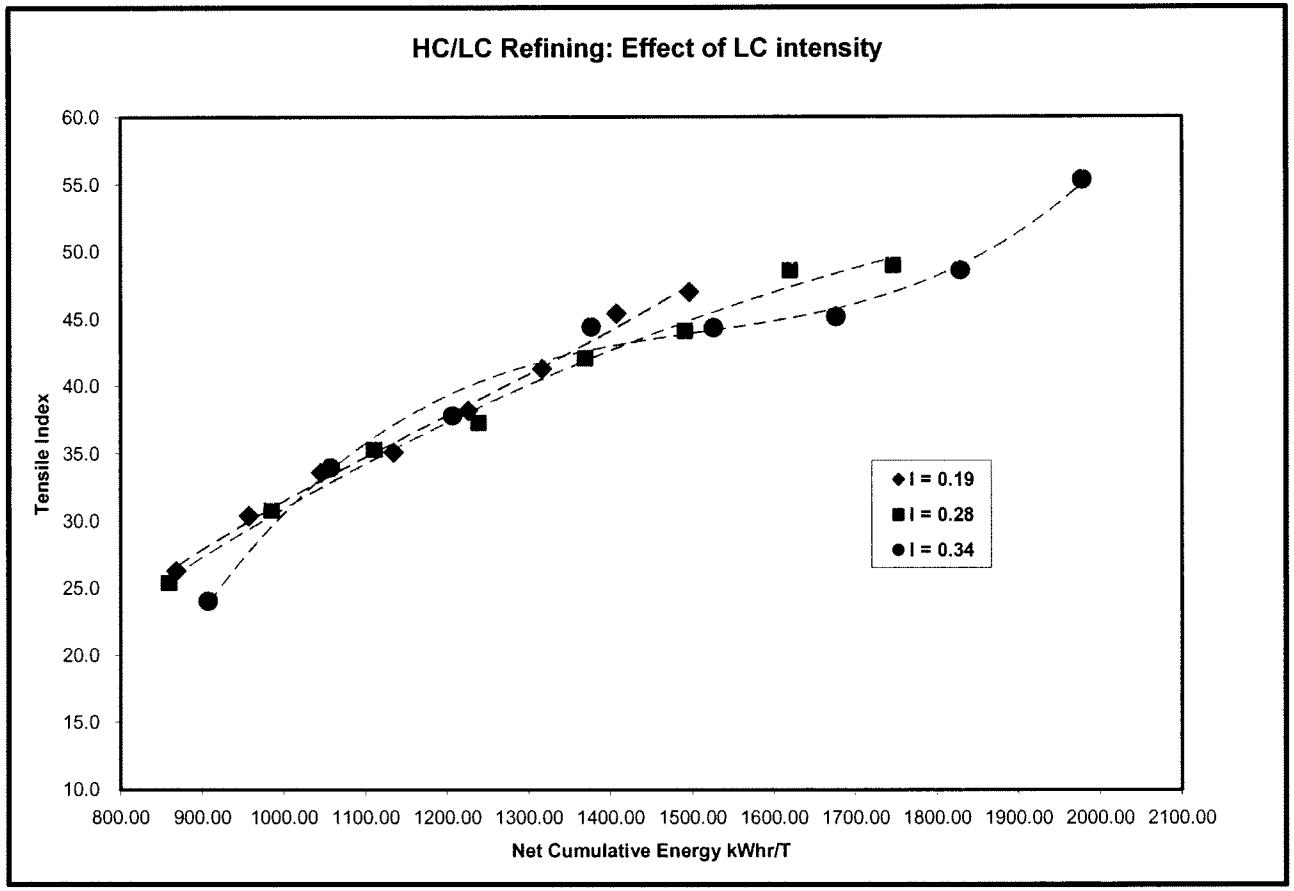
FIG. 14 shows a graph with the Tensile Index vs. the Net cumulative Energy kWhr/T with no alkaline peroxide treatment of pulp before the LC refining step.
Figure 15:
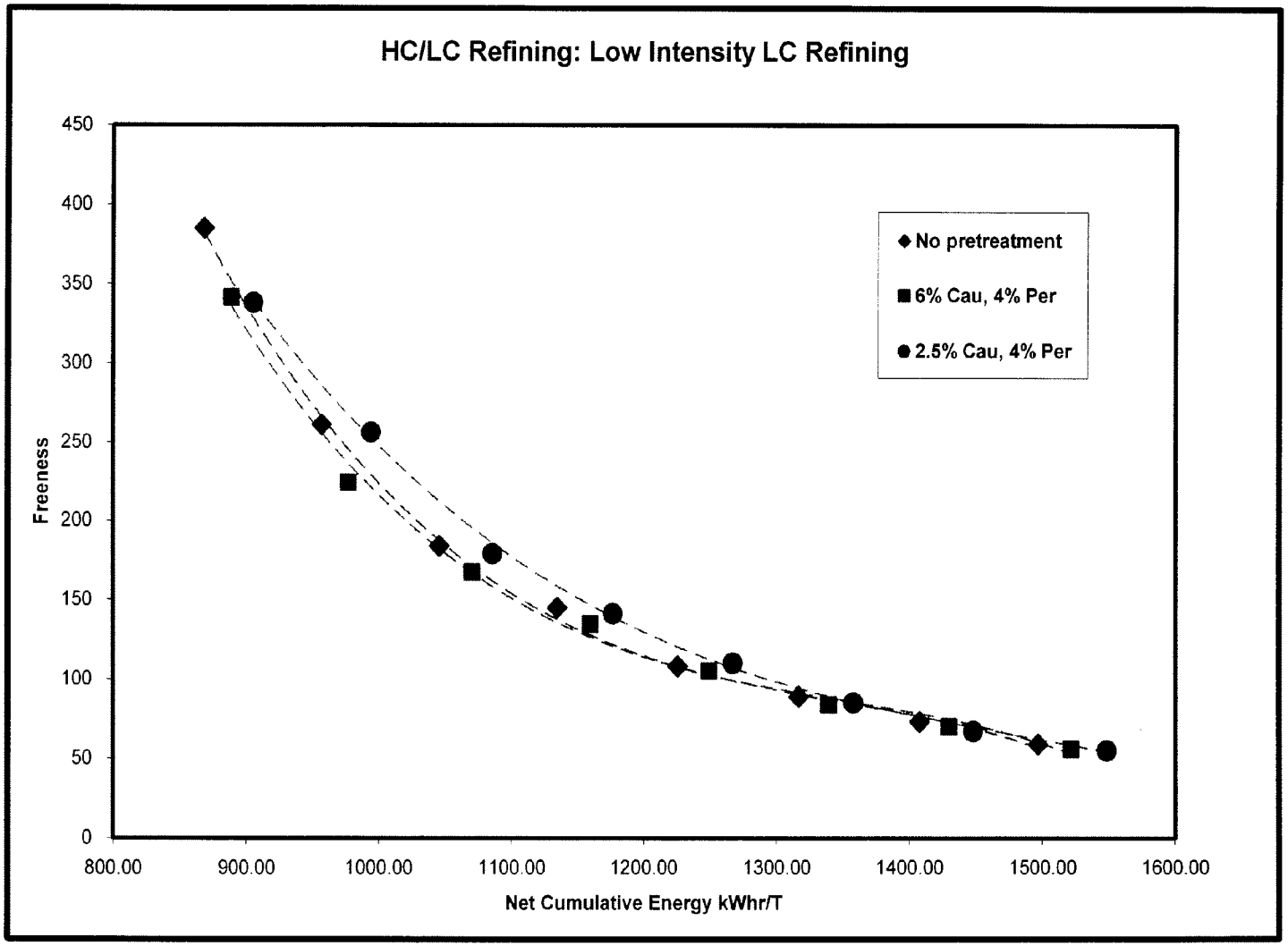
FIG. 15 shows a graph of low intensity LC refinement after chemical treatment. Freeness vs. Net cumulative Energy kWhr/T for the following treatments are shown: control (no pretreatment of the pulp), 6% caustic soda and 4% peroxide and 2.5% caustic soda and 4% peroxide. The treatment was for 1 hour at 75° C. and 20% consistency.
Figure 16:
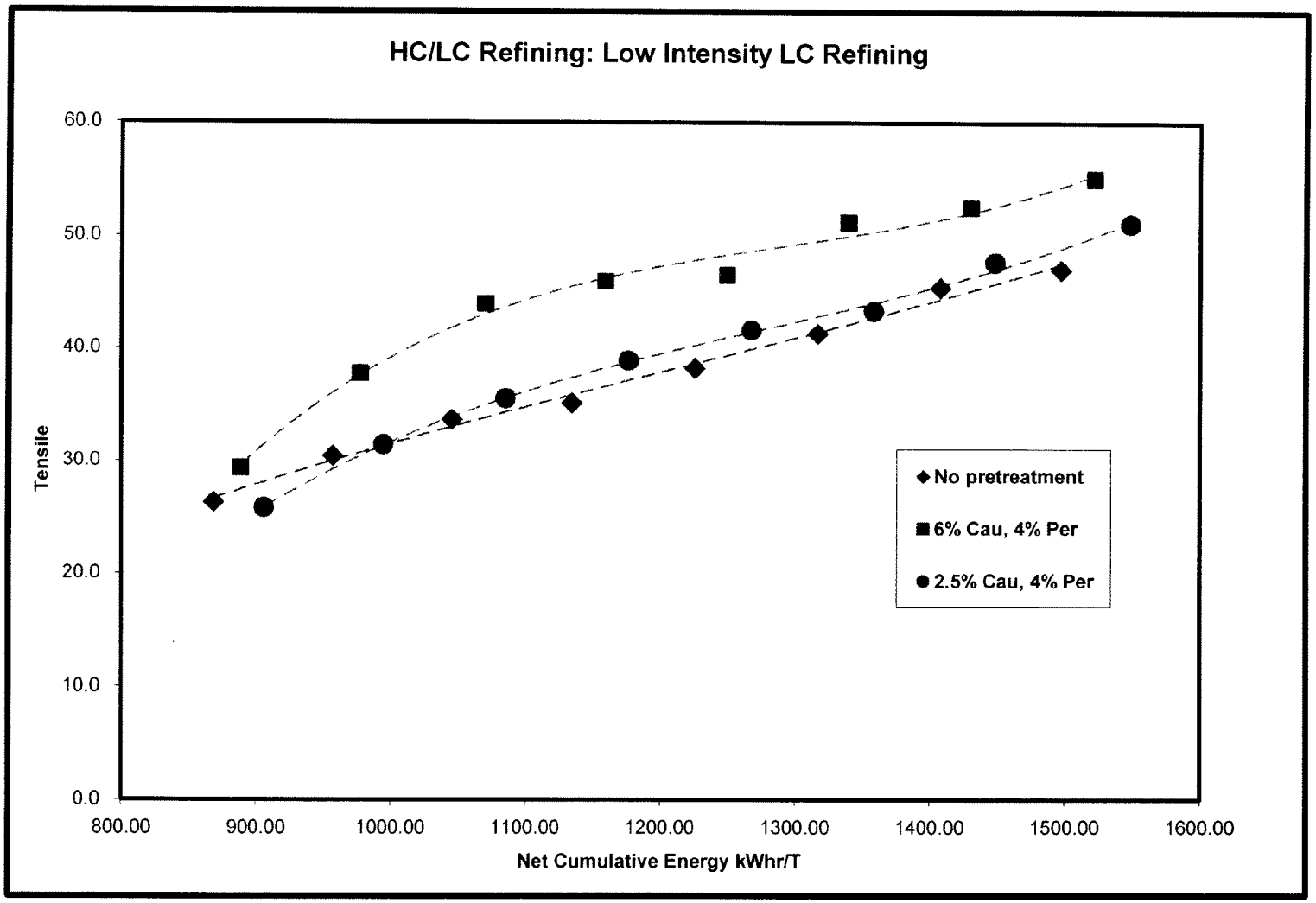
FIG. 16 shows a graph of low intensity LC refinement after chemical treatment. Tensile vs. Net cumulative Energy kWhr/T for the following treatments are shown: control (no pretreatment of the pulp), 6% caustic soda and 4% peroxide and 2.5% caustic soda and 4% peroxide. The treatment was for 1 hour at 75° C. and 20% consistency.

Correlation Between Tensile Strength and Acid Group Content Amongst the Alkaline Peroxide Treated Pulps It has previously been noted by many researchers that there is correlation between incorporation of acid groups into the fiber and increased tensile strength. This has been found to hold both for chemical pulps [15, 16] and for mechanical pulps [17]. FIG. 11 shows that, also for the treated pulps, there is a good correlation between acid group content and tensile strength among the pulps treated with 0%, 2% or 4% peroxide. In general, the more acid groups generated, the higher the tensile strength of the pulps. The generation of acid groups and development of tensile at a given alkali charge is similar for treatments with both 2% and 4% peroxide. Thus, the similar development in tensile for these treatments, noted previously (FIG. 3), is apparently the result of alkaline peroxide reactions that lead to similar acid group contents. In the absence of hydrogen peroxide, even at high alkali charge, few acid groups are formed. Both peroxide and high alkali are necessary to maximize acid group content and obtain maximum strength gains.

The lack of a relationship between WRV or fiber flexibility and tensile strength noted earlier also holds for acid group content. For example although the pulp treated with 6% alkali alone has a much lower acid group content compared to that treated with 6% alkali and 4% peroxide, the fiber flexibility and water retention values are very close (FIGS. 7 and 8). Fiber flexibility and WVR which reflect changes to the fiber wall seem to be more controlled by alkali which leads to small gains in tensile strength presumably through increased inter-fiber bonded area. The main gain in tensile strength comes from the generation of acid groups outside the fiber wall, on the fiber surface or in the fines, presumably increasing bond strength. These findings are consistent with the studies of Barzyk et al [16] on chemical pulps and Engstrand et al [17] and Ampulski [18] on mechanical pulps. These researchers concluded that generation of acid groups on fiber surfaces are much more important for strength development than introduction of acid group into the fiber wall.

Alkaline peroxide treatments on the mechanical pulp may significantly improve pulp quality allowing reduced electrical energy consumption in mechanical pulp production. Treatment of TMP with highly alkaline peroxide prior to low consistency refining provides tensile strength increases along with increases in brightness. The highly alkaline peroxide treatments do not promote further fibrillation during subsequent LC refining but protect the fibers from cutting. The main improvements in TMP properties gained through highly alkaline peroxide treatment are the result of the reaction of hydrogen peroxide to produce large amount of acid groups on the surface of the fibers or in the fines.

Pulp used for the validation of the laboratory simulation of LC refining was a thermomechanical pulp (TMP) prepared from whole log hemlock wood chips in the Andritz pilot plant, Springfield, Ohio was measured using standard techniques and the results are shown in FIGS. 13-16. Data obtained from FIGS. 13-16 is presented in Table 3.

TABLE 3

Characteristics of pulp produced according to the present invention (0C: caustic; 0P: 0 peroxide; 2.5% or 6C: 2.5% or 6% caustic, respectivley; 3P, 4P: 3% or 4% peroxide, respectively; NetSE: Net specific energy kWhr/T; LWFL: long weighted fiber length; Tensilte: km; brightness: % ISO).

| Pretreat | Intensity | Net SE | LWFL | Tensile | Bright. |
|---|---|---|---|---|---|
| 0C&0P | Low | 1,400 | 1.10 | 44 | 43.7 |
| 0C&0C | Med | 1,360 | 0.98 | 42 | 44.2 |
| 0C&0P | High | 1,340 | 0.95 | 42 | 44.2 |
| 6C&4P | High | 1,225 | 0.92 | 50 | 59.0 |
| 6C&3P | High | 1,310 | 1.02 | 51 | 58.0 |
| 6C&4P | Low | 1,400 | 1.12 | 51 | 61.0 |
| 2.5C&4P | Low | 1,400 | 1.08 | 49 | 72.0 |

Note

12% decrease in net specific energy, 14% increase in tensile strength and 15 point increase in brightness compared to low intensity refining without chemical treatment Chemical treatment: 1 hour @ 75° C. and 20% consistency References

[1] H. Muenster, "Energy savings in TMP by high temperature LC/MC refining," in *Int. Mechanical Pulping Conference,* 2005,

[2] S. Moldenius, "The effects of peroxide bleaching on the strength and surface properties of mechanical pulping," *J. Pulp Paper Sci., vol.* 10, pp. 172-177, 1984.

[3] W. L. Bohn and M. J. Sferrazza, "Alkaline peroxide mechanical pulping, A revolution in high yield pulping," in *Preprints,* 1989 *International Mechanical Pulping Conference*, pp. 184-200.

[4] Y. Bian, Y. Ni, Z. Yuan, C. Heitner and S. Beaulieu, "Improving TMP rejects refining through alkaline peroxide pretreatment for value-added mechanical papers," *Tappi J.*, vol. 6, pp. 24, 2007.

[5] R. P. Beatson, "Determination of sulfonate groups and total sulfur," in *Methods in Lignin Chemistry* S. Y. Lin and C. W. Dence, Eds. Berlin Heidelberg: Springer, 1992, pp. 473-484.

[6] R. Steadman and P. Luner, "The effect of wet fiber flexibility on sheet apparent density," *Papermaking Raw Materials*, pp. 311-337, 1985.

[7] A. C. Shaw, "Simulation of secondary refining," *Pulp & Paper Canada*, vol. 85, pp. 107-112, 1984.

[8] J. French and K. N. Maddern, "A mini pulp evaluation procedure," *APPITA, vol.* 47, pp. 38-44, 1994.

[9] G. X. Pan, "Relationship between dissolution of fiber materials and development of pulp strength in alkaline peroxide bleaching of mechanical pulp," *Holzforschung, vol.* 58, pp. 369-374, 2004.

[10] A. Korpela, "Improving the strength of PGW pine pulp by alkaline peroxide treatment," *Nordic Pulp and Paper Research Journal*, vol. 17, pp. 183-186, 2002.

[11] P. M. Shallhorn and A. Karnis, "The tear and tensile strength of mechanical pulps," *Trans. Tech. Sect. CPPA*, vol. 5, pp. TR92-TR99, 1979.

[12] D. Atack, C. Heitner and M. I. Stationwala, "Ultra high yield pulping of eastern black spruce refiner mechanical and thermomechanical pulps [TMP], pretreatment, properties, energy consumption." *Svensk Papperstidning* (Sweden), vol. 81, pp. 164-176, 1978.

[13] J. R. Presley and R. T. Hill, "Peroxide bleaching of (chemi)mechanical pulps," in *Pulp Bleaching: Principles and Practice* C. W. Dence and D. W. Reeve, Eds. TAPPI Atlanta, Ga., 1996, pp. 457-489.

[14] J. Been, "A novel approach to kinetic modeling of the hydrogen peroxide brightening of mechanical pulp," *Tappi Journal* (USA), pp. 144-152, 1995.

[15] A. M. Scallan and J. Grignon, "The effect of cations on pulp and paper properties," *Svensk Papperstidn*, vol. 82, pp. 40-47, 1979.

[16] D. Barzyk, D. H. Page and A. Ragauskas, "Carboxylic acid groups and fiber bonding," in *The Fundamentals of Papermaking Materials: Transactions of the* 11*th Fundamental Research Symposium,* 1997, pp. 893-907.

[17] P. Engstrand, B. Sjogren, K. Olander and M. Htun, "The significance of carboxylic groups for the physical properties of mechanical pulp fibers," in *6th International Symposium Wood Pulping Chemistry,* 1991, pp. 75-79.

[18] R. S. Ampulski, "The influence of fiber surface charge on tensile strength," in *Tappi Papermakers Conference,* 1985, All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A process for producing thermomechanical and chemithermomechanical pulp comprising:

(a) processing a pretreated wood material using a primary high consistency (HC) refining step to produce a first pulp;

(b) dividing the first pulp into a primary stream and a secondary stream, each of the primary stream and the secondary stream consisting of the first pulp;

(c) processing the secondary stream using a secondary HC refining step to produce a partially refined pulp;

(d) treating the primary stream with alkaline-peroxide liquor to produce a treated pulp;

(e) combining the partially refined pulp and the treated pulp in a common location prior to removing the latency of the partially refined pulp and the treated pulp; and (f) processing the partially refined pulp and the treated pulp by one or more than one second refining step to produce a second pulp.

2. The process of claim 1, wherein the alkaline-peroxide liquor has a pH of from about 11 to about 13.

3. The process of claim 2, wherein the alkaline peroxide liquor comprises hydrogen peroxide, sodium hydroxide and a stabilizer agent.

4. The process of claim 1, wherein the one or more than one second refining step (step f) comprises a low consistency (LC) refining step.

5. The process of claim 3, wherein the hydrogen peroxide is between 0.5-4% (wt/wt), and the sodium hydroxide is between 0.5-7% (wt/wt).

6. The process of claim 3, wherein the stabilizing agent is sodium silicate, magnesium sulfate, a chelating agent or a combination thereof.

7. The process of claim 1, wherein the wood material is softwood or hardwood material or a combination thereof.

8. The process of claim 1, wherein step (a) further comprises applying a chelating agent to the first pulp during HC refining.

* * * * *